US008272795B2

(12) United States Patent
Tanabe et al.

(10) Patent No.: US 8,272,795 B2
(45) Date of Patent: Sep. 25, 2012

(54) CARTRIDGE AND PRINTER

(75) Inventors: Minoru Tanabe, Kawasaki (JP); Etsuro Suzuki, Beppu (JP); Masahiko Chaya, Yokohama (JP); Kenji Ito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 688 days.

(21) Appl. No.: 12/438,757

(22) PCT Filed: Mar. 7, 2008

(86) PCT No.: PCT/JP2008/054680

§ 371 (c)(1),
(2), (4) Date: Feb. 25, 2009

(87) PCT Pub. No.: WO2008/114703

PCT Pub. Date: Sep. 25, 2008

(65) Prior Publication Data

US 2009/0324314 A1 Dec. 31, 2009

(30) Foreign Application Priority Data

| | | |
|---|---|---|
| Mar. 16, 2007 | (JP) | 2007-069061 |
| Mar. 16, 2007 | (JP) | 2007-069062 |
| Mar. 16, 2007 | (JP) | 2007-069063 |
| Mar. 16, 2007 | (JP) | 2007-069064 |
| Mar. 22, 2007 | (JP) | 2007-075401 |
| Jan. 28, 2008 | (JP) | 2008-016843 |

(51) Int. Cl.
*B41J 35/28* (2006.01)

(52) U.S. Cl. ..... 400/208.1

(58) Field of Classification Search ..... 400/208.1, 400/208; 347/107
See application file for complete search history.

(56) References Cited

U.S. PATENT DOCUMENTS

| | | | | |
|---|---|---|---|---|
| 4,755,833 | A * | 7/1988 | Tanigawa et al. | 347/176 |
| 4,899,629 | A | 2/1990 | Umebayashi | 83/38 |
| 5,243,360 | A | 9/1993 | Tomoda et al. | 346/76 |
| 5,335,055 | A * | 8/1994 | Bliss | 399/155 |
| 5,927,876 | A | 7/1999 | Fox | 400/579 |
| 6,069,642 | A | 5/2000 | Isobe | 347/176 |
| 6,580,446 | B2 | 6/2003 | Yamakawa et al. | 347/218 |
| 6,690,405 | B2 | 2/2004 | Yamakawa et al. | 347/221 |
| 7,173,642 | B2 | 2/2007 | Nureki | 347/187 |

(Continued)

FOREIGN PATENT DOCUMENTS

| | | |
|---|---|---|
| EP | 0 381 154 | 8/1990 |

(Continued)

OTHER PUBLICATIONS

Office Action in Korean Patent Application No. 10-2009-7013659, dated Jun. 9, 2011.

*Primary Examiner* — Seung Lee
(74) *Attorney, Agent, or Firm* — Fitzpatrick, Cella, Harper & Scinto

(57) ABSTRACT

A cartridge detachable from a printer has a roll paper unit including roll paper, a roller, and flanges, and a separation member used to pull out the roll paper from the roll paper unit. Upon rotating the roll paper unit in a direction to feed out the roll paper, the roll paper is brought into contact with the separation member, thereby pulling out the roll paper from the roll paper unit and feeding out the roll paper to outside the cartridge.

5 Claims, 32 Drawing Sheets

U.S. PATENT DOCUMENTS

| | | | | |
|---|---|---|---|---|
| 2003/0146943 | A1 | 8/2003 | Lehmkuhl et al. | 346/24 |
| 2006/0238600 | A1 | 10/2006 | Vandermeulen et al. | |
| 2007/0195146 | A1 | 8/2007 | Tanabe | 347/104 |
| 2007/0195147 | A1 | 8/2007 | Tanabe | 347/104 |
| 2008/0159774 | A1 | 7/2008 | Tanabe et al. | 399/90 |
| 2008/0253803 | A1 | 10/2008 | Nittani et al. | 399/114 |

FOREIGN PATENT DOCUMENTS

| | | | | |
|---|---|---|---|---|
| EP | 938019 | A2 | * | 8/1999 |
| EP | 1 219 453 | | | 7/2002 |
| EP | 1 486 422 | | | 12/2004 |
| JP | 02-188359 | A | | 7/1990 |
| JP | 02-112455 | U | | 9/1990 |
| JP | 02-117154 | U | | 9/1990 |
| JP | 03-124471 | A | | 5/1991 |
| JP | 05-177893 | A | | 7/1993 |
| JP | 63-276576 | A | | 11/1998 |
| JP | 11-129563 | | | 5/1999 |
| JP | 2000-108442 | | | 4/2000 |
| JP | 2002-127533 | A | | 5/2002 |
| JP | 2003211763 | A | * | 7/2003 |
| JP | 2004-058362 | A | | 2/2004 |
| KR | 10-0416933 | | | 2/2004 |
| RU | 2005123352 | A | | 1/2006 |
| WO | 2004/058509 | | | 7/2004 |
| WO | WO 2005/092629 | | | 10/2005 |

* cited by examiner

CARTRIDGE AND PRINTER

TECHNICAL FIELD

The present invention relates to a printer which prints image data, and a cartridge loaded to the printer.

BACKGROUND ART

In recent years, printers which import image data acquired by image sensing devices such as digital still cameras, and the like and print them on printing media such as photographic printing paper have prevailed at home.

In such home use printer, since the user need only set an ink ribbon and photographic printing paper in advance, he or she enjoy photo printing with high image quality by importing image data and inputting a printing instruction. For this reason, people who enjoy photo printing at home are increasing recently.

For such home use printer, advance preparations (setting of an ink ribbon and photographic printing paper, importing of image data, and the like) are required to be simplified as much as possible, and proposals that aim at improving the operability in preparations have been made conventionally.

For example, a printer which comprises a cartridge that integrates an ink ribbon and photographic printing paper is known. Using such cartridge, two works, that is, settings of an ink ribbon and photographic printing paper are reduced to one work, that is, loading of a cartridge, thus simplifying the preparations.

Note that it is a common practice for the integrated cartridge described above to use cut sheets as photographic printing paper. However, photographic printing paper arranged in a cartridge is not limited to cut sheets, but roll paper prepared by winding strip-shaped photographic printing paper around a roller may be used.

When roll paper is used as photographic printing paper, a compact cartridge can hold large amounts of photographic printing paper, and cartridges for different print sizes can share a feeding mechanism.

Upon printing using cut sheets, since a sheet needs to be held at the time of printing, a cut sheet larger than a printing region must be prepared. After printing, the user must cut a portion which is set to be larger than the printing region so as to hold the sheet by himself or herself. By contrast, in case of roll paper, a printer comprises a cutter for cutting photographic printing paper, and photographic printing paper is cut inside the printer. Hence, only the printing region can be cut and provided to the user.

When the cartridge houses roll paper as photographic printing paper, the roll paper operates as follows in the printer upon printing.

The roll paper wound around the roller is pulled outside the cartridge, and is inserted between a thermal head and platen roller via conveyance rollers together with an ink ribbon. After that, since a printing region is reciprocally conveyed before and after the thermal head while the ink ribbon is superposed on the printing region, thus applying inks of respective colors. The roll paper on which the inks are applied is cut at the cutting position, and is discharged. In this way, printing is complete, and the pulled roll paper is rewound into the cartridge, thus returning a state before the beginning of printing.

Upon completion of printing and rewinding the roll paper, if the leading end of the roll paper is completely rewound into the cartridge, the roll paper cannot be pulled out from the cartridge again.

When the pulled roll paper is rewound after printing, the leading end of the roll paper needs to be controlled to stop while it is left outside the cartridge. However, in this case, since the roll paper extends outside the cartridge, it may be damaged upon detaching the cartridge.

On the other hand, by providing rollers inside the cartridge, it is possible to feed the roll paper which is rewound inside the cartridge to outside the cartridge. However, in this case, the cartridge must have a complicated structure.

When the cartridge is detached from the printer after printing, and the roller of the cartridge and a rotation mechanism of the printer are disengaged, the roller of the cartridge is free to pivot. For this reason, if the roller pivots and the leading end of the roll paper is unwantedly rewound, the leading end of the roll paper can never be pulled out from the cartridge.

For this reason, it is desired for the cartridge which houses the roll paper to adapt an arrangement which can surely pull the roll paper outside the cartridge, so as to attain smooth printing upon re-loading the cartridge.

DISCLOSURE OF INVENTION

One aspect of the present invention is to solve all or at least one of the aforementioned problems.

According to one aspect of the present invention, there is provided a cartridge detachable from a printer for printing an image on roll paper, characterized by comprising:

roll paper wound around a roller;

flanges which are provided to end portions of the roller, are used to hold the roll paper wound around the roller, and are made up of elastic members; and a separation member which is used to feed out the roll paper to outside the cartridge, characterized in that the roll paper is brought into contact with the separation member and is fed outside the cartridge when the roller is rotated in a direction to feed out the roll paper, and the roll paper which has been fed outside the cartridge is taken up on outer circumferential portions of the flanges and is rewound into the cartridge when the roller is rotated in a direction to rewind the roll paper.

Further features of the present invention will become apparent from the following description of exemplary embodiments with reference to the attached drawings.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will be described in detail hereinafter with reference to the accompanying drawings. In the following description, assume that "printing" indicates a series of overall operations from when photographic printing is made based on a printing instruction from the user until roll paper is cut into a predetermined size and the cut paper sheet is discharged. Also, assume that "photographic printing" indicates, of the printing operations, an operation for printing an image on roll paper by thermally transferring ink applied on an ink ribbon to the roll paper.

[First Embodiment]

1. Outer Appearance of Printer and Cartridge

Figure 1:
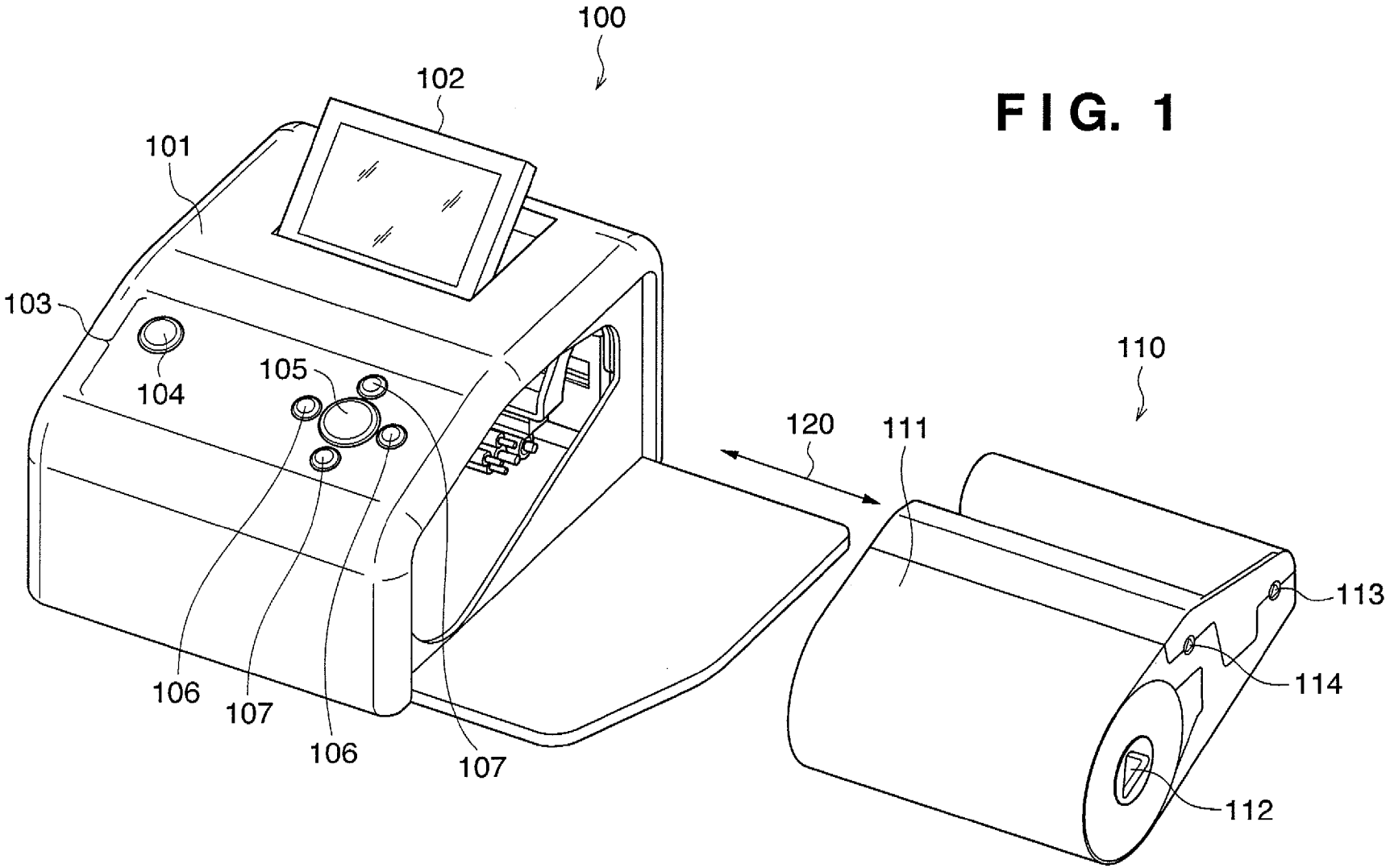
FIG. 1 is a view showing the outer appearance of a printer 100 and a cartridge 110 used in the printer 100.

FIG. 1 is a view showing the outer appearance of a printer 100 and a cartridge 110 used in the printer 100 according to this embodiment.

As shown in FIG. 1, the printer 100 comprises a housing 101 having a loading unit, the side surface of which is opened/closed to allow the cartridge 110 to be detachable (loadable/unloadable) in the directions of a double-headed arrow 120. A display unit 102 and console 103 are arranged on the upper portion of the housing 101.

The display unit 102 comprises a display screen of an LCD or the like, and displays image data to be printed and menus used to input setting data required for printing.

The console 103 comprises a power switch 104 used to instruct to turn on/of the power supply of the printer, and a select switch 105 used to select various menus displayed on the display unit 102. Furthermore, around the select switch 105, right and left keys 106 and up and down keys 107 used to move a cursor displayed on the display unit 102 to a desired position are arranged.

The cartridge 110 houses an ink ribbon applied with ink, and roll paper (strip-shaped printing medium wound around a roller) as photographic printing paper. Before the cartridge 110 is loaded into the printer 100, the roll paper is sealed by the housing 111, and the user cannot directly touch the roll paper. Upon printing, the roll paper is pulled out from the cartridge 110, and a thermal head of the printer transfers ink applied to the ink ribbon onto the roll paper, thus attaining photographic printing.

Reference numeral 112 denotes a rotation shaft of the roller around which the roll paper is wound. When the cartridge 110 is loaded into the printer 100, the rotation shaft 112 engages with a rotation mechanism of a feeding motor of the printer 100, and its rotation is controlled by the printer 100.

Reference numerals 113 and 114 respectively denote rotation shafts of a supply roller and take-up roller of the ink ribbon. When the cartridge 110 is loaded into the printer 100, the rotation shaft 114 of the take-up roller is coupled to a rotation mechanism of an ink ribbon take-up motor of the printer 100, and its rotation is controlled by the printer.

2. Functional Arrangement of Printer

Figure 2:
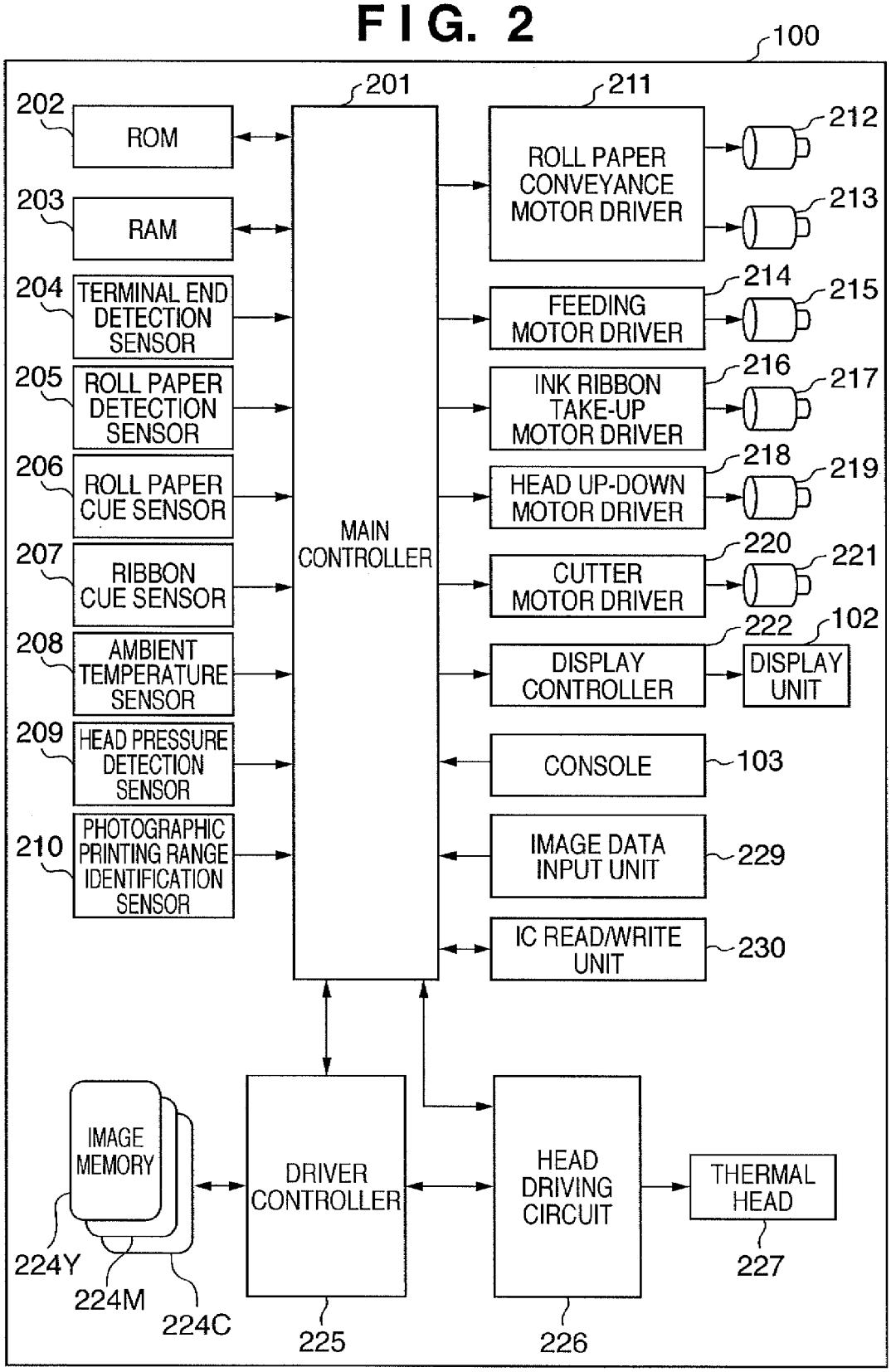
FIG. 2 is a block diagram showing the functional arrangement of the printer 100.

FIG. 2 is a block diagram showing the functional arrangement of the printer 100. Reference numeral 201 denotes a main controller which controls the overall printer 100.

Reference numeral 202 denotes a ROM which is connected to the main controller 201 and stores a control program and the like. The main controller 201 operates according to the control program stored in the ROM 202. A RAM 203 is used as a work memory for the arithmetic processing of the main controller. The RAM 203 also temporarily stores various setting data and the like input via the console 103.

Reference numerals 224Y, 224M, and 224C denote image buffers which store image data received via an image data input unit 229. The yellow image buffer 224Y temporarily stores yellow image data, and the image buffers 224M and 224C respectively temporarily store magenta and cyan image data.

Reference numeral 227 denotes a thermal head which sublimates ink applied to the ink ribbon by heat generated by a built-in heating element, thus photographically printing an image on the roll paper.

Reference numeral 226 denotes a head driving circuit which drives the heating element (not shown) built in the thermal head 227. A driver controller 225 connected to the main controller 201 controls the head driving circuit 226 using image data recorded in the image buffers 224Y to 224C in a bitmap format, thus attaining photographic printing.

Reference numeral 211 denotes a roll paper conveyance motor driver which drives driving motors 212 and 213. The driving motors 212 and 213 (rotation driving unit) are coupled to an uncurl roller, grip roller, discharge roller, discharge kick-out roller, and the like via a rotation mechanism, and drives these rollers to convey the roll paper.

Reference numeral 214 denotes a feeding motor driver which controls rotation of a feeding motor 215. When the cartridge 110 is attached, the feeding motor 215 is coupled to the roller around which the roll paper is wound via the rotation mechanism, and the rotation of that roller is controlled by the feeding motor driver 214.

Reference numeral 216 denotes an ink ribbon take-up motor driver, which controls the rotation of an ink ribbon take-up motor 217. When the cartridge 110 is attached, the take-up roller of the ink ribbon is coupled to the ink ribbon take-up motor 217 via the rotation mechanism, and the take-up operation of the ink ribbon is controlled by the ink ribbon take-up motor driver 216.

Reference numeral 218 denotes a head up-down motor driver. When this driver 218 controls the rotation of a head up-down motor 219 which moves the thermal head 227 upward or downward, the thermal head 227 moves between the photographic printing position and escape position.

Reference numeral 220 denotes a cutter motor driver. The cutter motor driver 220 controls a cutter motor 221 which drives a cutter blade and cutter bed blade that form a cutter unit, thereby cutting the roll paper.

Reference numeral 204 denotes a terminal end detection sensor, which is arranged in the roller of the cartridge 110. When the remaining amount of the roll paper wound around the roller becomes less than one turn, the sensor 204 detects this. Upon detection of the terminal end, the display unit 102 displays a message indicating that the remaining amount of the roll paper is small.

Reference numeral 205 denotes roll paper detection sensors, which detect the leading end of the roll paper which is arranged in the cartridge 110, and is fed out and discharged from a cartridge exit. The roll paper detection sensors are arranged near the cartridge exit to oppose the widthwise direction of the roll paper, and respectively detect the ends (right and left ends) in the widthwise direction of the roll paper discharged from the cartridge exit. Based on the difference between the detection timings of the roll paper detection sensors 205, the printer 100 can recognize a skew in the widthwise direction of the roll paper pushed out from the cartridge exit.

Reference numeral 206 denotes a roll paper cue sensor, which is arranged behind the platen roller which opposes the thermal head 227, and detects passage of the leading end of the roll paper pulled out from the cartridge 110 behind the position of the platen roller.

Reference numeral 207 denotes a ribbon cue sensor, which detects an identification band applied to the leading end portion of each color of the ink ribbon. The take-up operation of the ink ribbon by the ink ribbon take-up motor 217 is controlled based on the detection result of the ribbon cue sensor 207.

Reference numeral 208 denotes an ambient temperature sensor which detects the ambient temperature of an environment where the printer 100 is equipped. Input energy to be input to the thermal head 227 by the head driving circuit 226 is controlled based on the detection result of the ambient temperature sensor 208.

Reference numeral 209 denotes a head pressure detection sensor, which detects a head pressure when the thermal head 227 moves downward to the photographic printing position, and presses the ink ribbon and roll paper between itself and the platen roller.

Reference numeral 210 denotes a photographic printing range identification sensor, which is arranged in the vicinity of the cutter unit, and identifies a range that has undergone photographic printing.

Reference numeral 222 denotes a display controller which controls to display image data to be printed and menus used to input setting data required for printing on the display unit 102.

Reference numeral 230 denotes an IC read/write unit, which reads out information from a cartridge information chip (IC) arranged in the cartridge 110, and writes information in the IC. The information to be read out from the IC includes, for example, the size (the width, thickness, and length) of the roll paper, the characteristics of the roll paper, the roller diameter, manufacture information of the ink ribbon, the characteristic information of the ink ribbon, the diameter of the ink ribbon take-up roller, the diameter of the ink ribbon supply roller, and the like. The information to be written in the IC includes, for example, information indicating the number of printed sheets, information indicating the number of sheets as printing errors, information indicating the factors of the printing errors, and the like.

3. Detailed Arrangement of Cartridge

Figure 3:
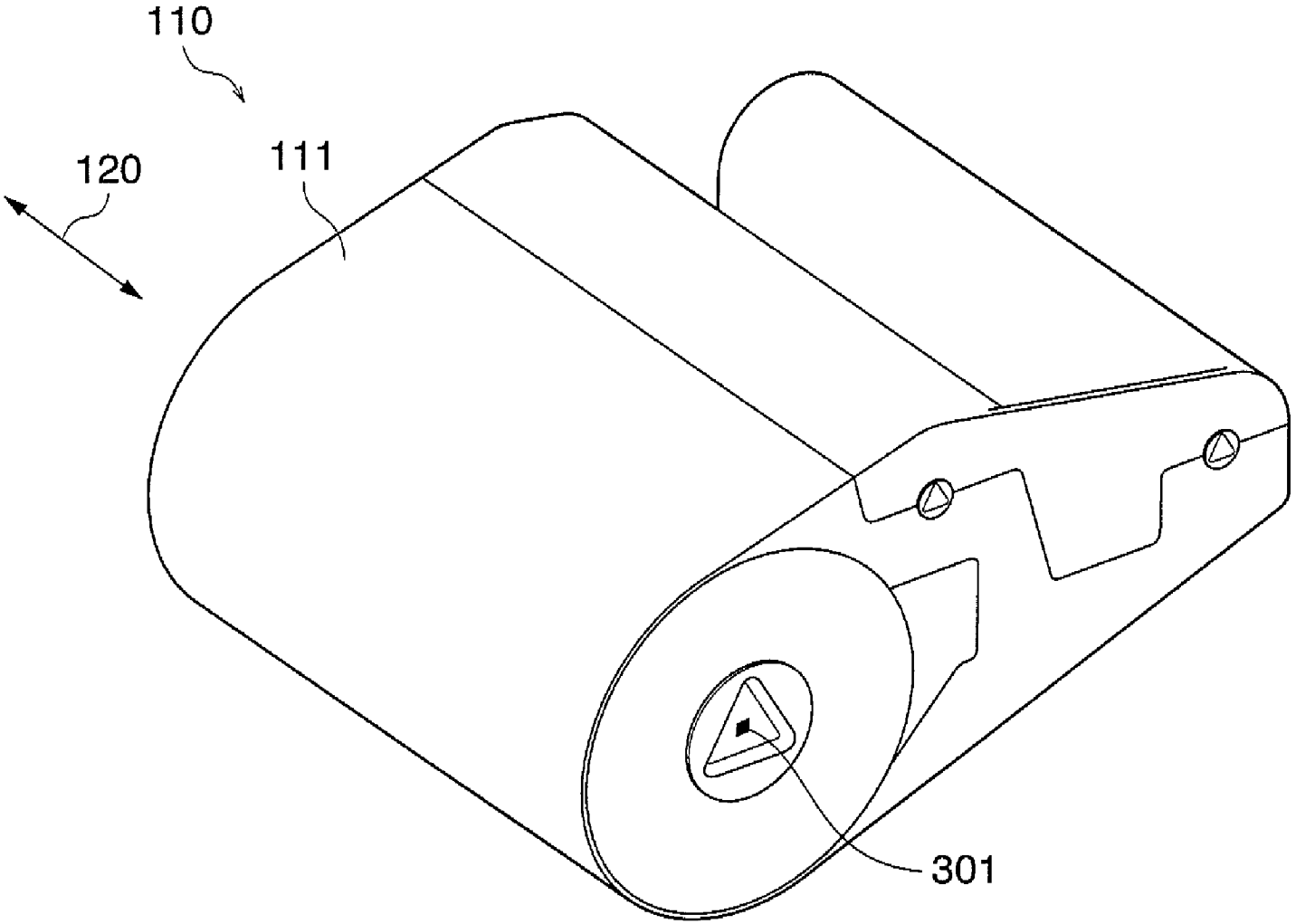
FIG. 3 is a view showing the outer appearance of the cartridge 110.

The detailed arrangement of the cartridge 110 will be described below. FIG. 3 shows the outer appearance of the cartridge 110.

As described above, when the cartridge 110 is detached from the printer 100, the roll paper is housed in the housing 111, and the user cannot directly externally touch the roll paper. With this arrangement, foreign matter or the like can be prevented from entering the cartridge 110.

Reference numeral 301 denotes a contact which transmits the output of the terminal end detection sensor 204 arranged in the roller to the printer 100. When the cartridge 110 is loaded into the printer 100, the contact 301 is coupled to a contact (not shown) of the printer 100 side, and transmits the output of the terminal end detection sensor 204 to the printer 100.

Figure 4:
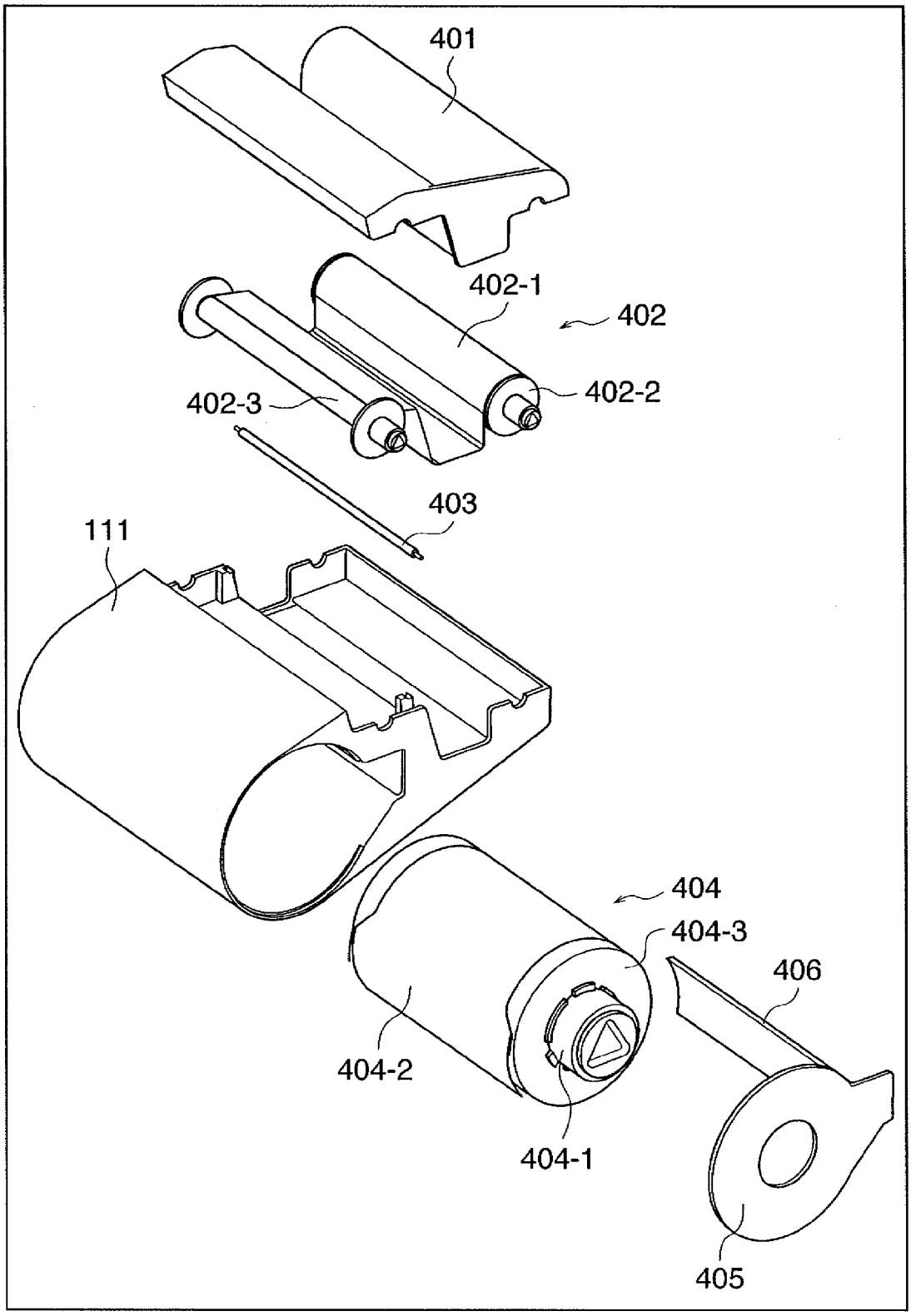
FIG. 4 is an exploded view of the cartridge 110.

FIG. 4 is an exploded view of the cartridge 110. The internal arrangement of the cartridge 110 will be described below with reference to FIG. 4.

Referring to FIG. 4, reference numeral 401 denotes an upper housing, which covers the upper portion of an ink ribbon unit 402 (the upper housing 401 serves as a first housing that houses an ink ribbon wound around the supply roller and a second housing that houses the ink ribbon after ink has been transferred to a printing medium). Reference numeral 402 denotes an ink ribbon unit which comprises a supply roller 402-2 around which an unused ink ribbon 402-1 is wound, and a take-up roller 402-3 which takes up the used ink ribbon 402-1. The supply roller 402-2 and take-up roller 402-3 are pivotally supported by the housing 111.

Reference numeral 403 denotes a guide roller which specifies the conveyance path of the ink ribbon 402-1 when the take-up roller 402-3 takes up the used ink ribbon 402-1. The guide roller 403 is pivotally supported by the housing 111.

Reference numeral 404 denotes a roll paper unit which comprises a roller 404-1, roll paper 404-2, and flanges 404-3. The roller 404-1 is pivotally supported by a side housing 405 and the housing 111. Note that details of the roll paper unit 404 will be described later with reference to FIG. 5.

The side housing 405 covers the side surface of the roll paper unit 404, and axially supports the roller 404-1. Also, the side housing 405 comprises a separation member 406 used to peel the leading end of the roll paper 404-2 wound around the roller 404-1 from the wound portion (roller 404-1).

Figure 13A:
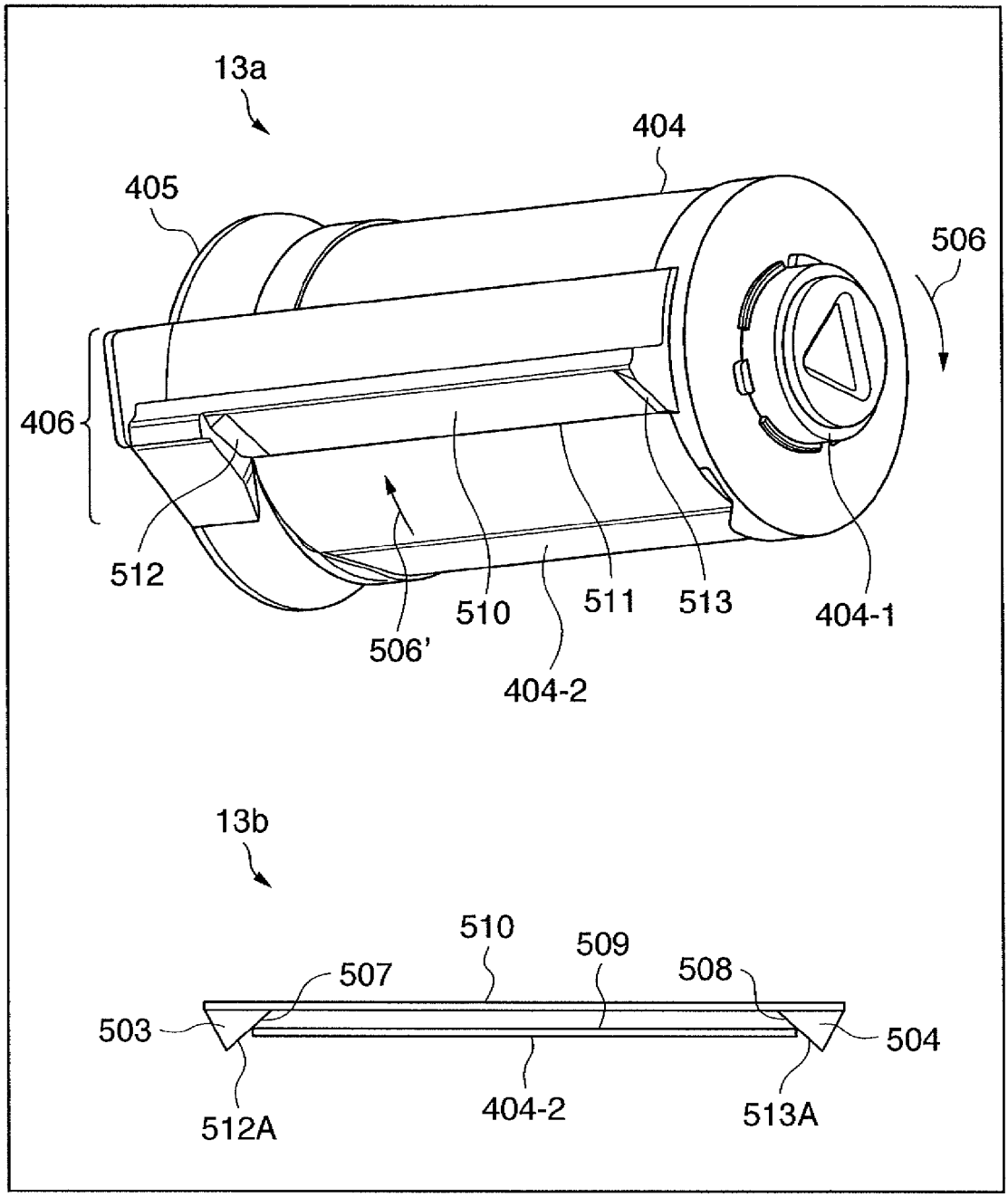
FIG. 13A is a perspective view of the roll paper unit 404 and a side housing 405.

Reference numeral 13*a* in FIG. 13A is a perspective view of the roll paper unit 404 combined with the side housing 405, when viewed from the separation member 406 side of the side housing 405 (13*a* in FIG. 13A shows the separation member 406 in detail).

As shown in 13*a* in FIG. 13A, the separation member 406 comprises a guide plate 510 to guide the roll paper 404-2, which travels in the direction of an arrow 506', toward a cartridge exit direction so as to discharge the roll paper 404-2 outside the cartridge 110, when the roller 404-1 rotates in the direction of an arrow 506. The roll paper 404-2 which travels in the direction of the arrow 506' is peeled in turn from the roller 404-1 by an end 511 of the guide plate 510. That is, when the rotation mechanism of the printer rotates the roller 404-1 in the direction of the arrow 506, the roll paper 404-2 is peeled from the roller 404-1 by the separation member 406, and is discharged from the cartridge by further rotation. Then, the roll paper 404-2 is fed onto the conveyance path in the printer. Hence, even when the cartridge 110 has no dedicated rollers and the like used to feed out the roll paper, the roll paper 404-2 can be easily discharged from the cartridge 110.

Upon guiding the peeled roll paper 404-2 toward the cartridge exit direction, the roll paper 404-2 is supported by slope members 512 and 513 provided to the two ends of the guide plate 510 without being in direct contact with the guide plate 510.

Reference numeral 13*b* in FIG. 13A shows the state in which the peeled roll paper 404-2 is supported by the slope members 512 and 513 when it is guided toward the cartridge exit direction.

As shown in 13*b* in FIG. 13A, the slope members 512 and 513 are arranged at the two ends of the guide plate 510 in correspondence with the width of the roll paper 404-2, and their slopes 512A and 513A support two end portions 507 and 508 of the roll paper 404-2 in the widthwise direction. As a result, a photographic printing surface 509 of the roll paper 404-2 is conveyed without being in contact with the guide plate 510.

In this way, since the roll paper 404-2 is supported at the two end portions in the widthwise direction, the roll paper 404-2 can be stably guided toward the cartridge exit direction without damaging the photographic printing surface 509 of the roll paper 404-2.

Figure 13B:
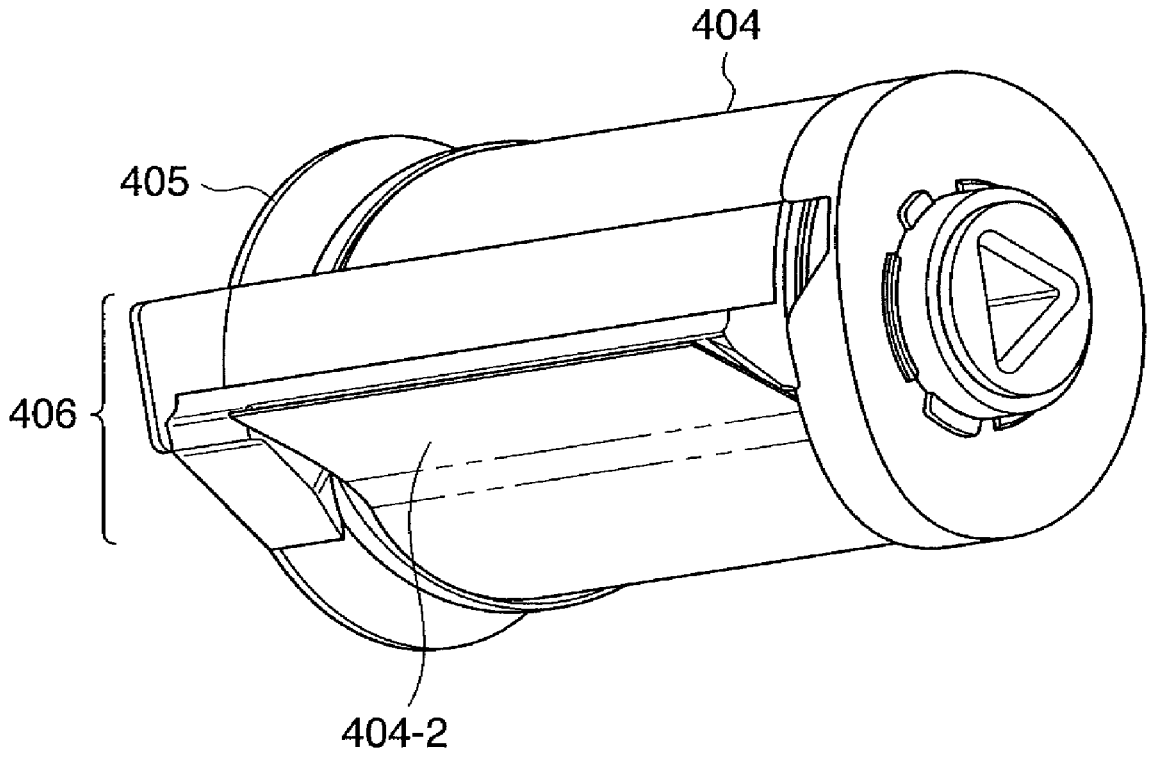
FIG. 13B is a perspective view of the roll paper unit 404 and side housing 405.

FIG. 13B shows the state in which the peeled roll paper 404-2 is guided toward the cartridge exit direction.

Figure 5:
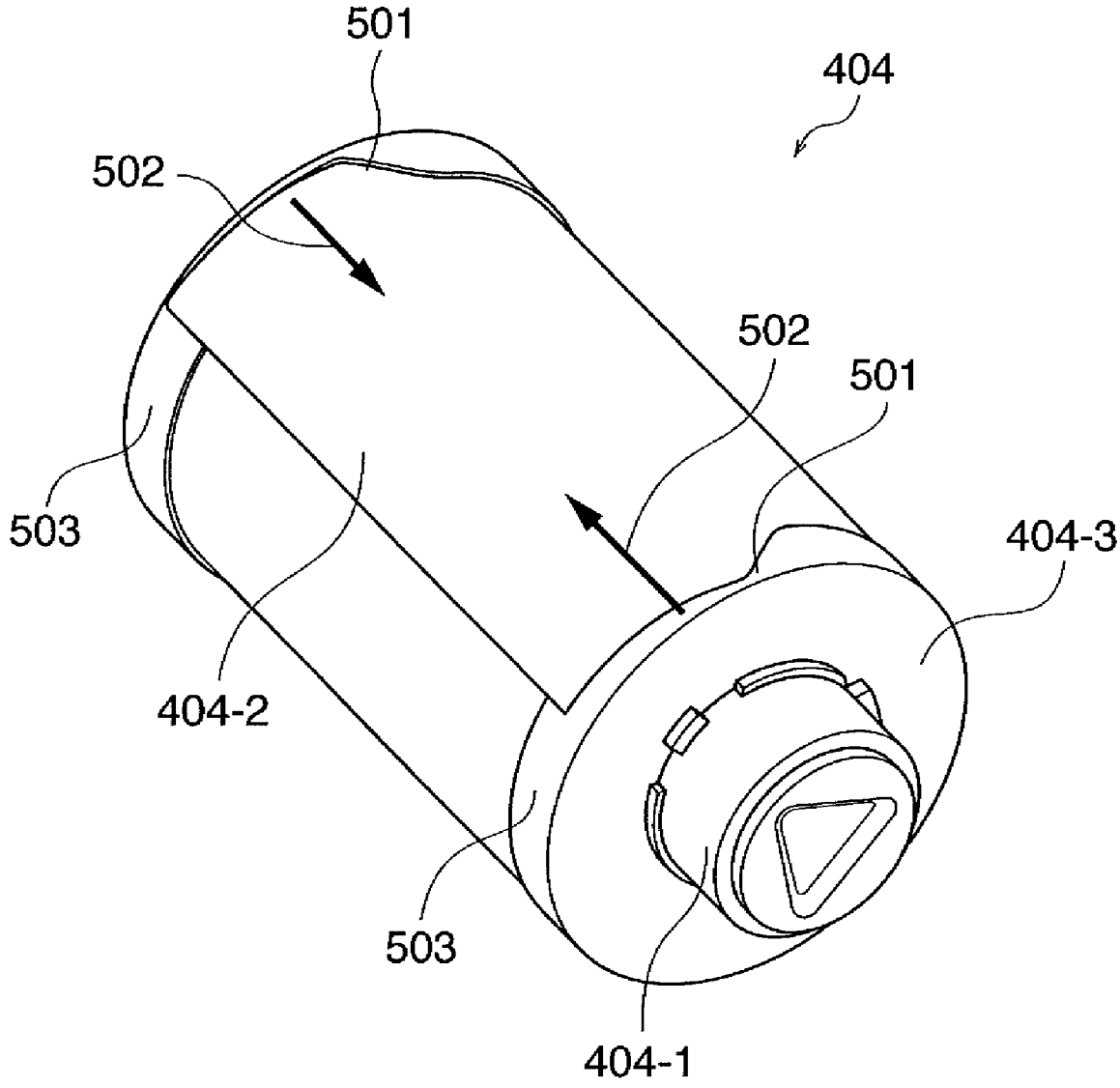
FIG. 5 is a view for explaining details of a roll paper unit 404.

Details of the roll paper unit 404 will be described below with reference to FIG. 5. The flanges 404-3 of elastic members are arranged at the two ends of the roller 404-1. These flanges can prevent the roll paper 404-2 from deviating in the widthwise direction. Each flange 404-3 has a cylindrical holding portion 503, which prevents the roll paper 404-2 from being unwound in the outer diameter direction of the flange 404-3 by its rigidity. The holding portions 503 are formed with notches 501 that hold the two ends of the leading end portion of the roll paper.

By rotating the roller 404-1, the roll paper unit 404 rotates. As described above, upon rotating the roll paper unit 404, the roll paper 404-2 is peeled from the roll paper unit 404 by the separation member 406, and is guided toward the cartridge exit direction, as shown in FIG. 13B.

Since the flanges 404-3 are formed of elastic members, they are stretched and curved in the widthwise direction of the roll paper 404-2 when the roll paper 404-2 is peeled by the separation member 406. Since the flanges 404-3 are curved, the roll paper 404-2 climbs over the holding portions 503 of the flanges 404-3 and is peeled from the roll paper unit 404.

The notches 501 will be described in detail below.

Figure 16:
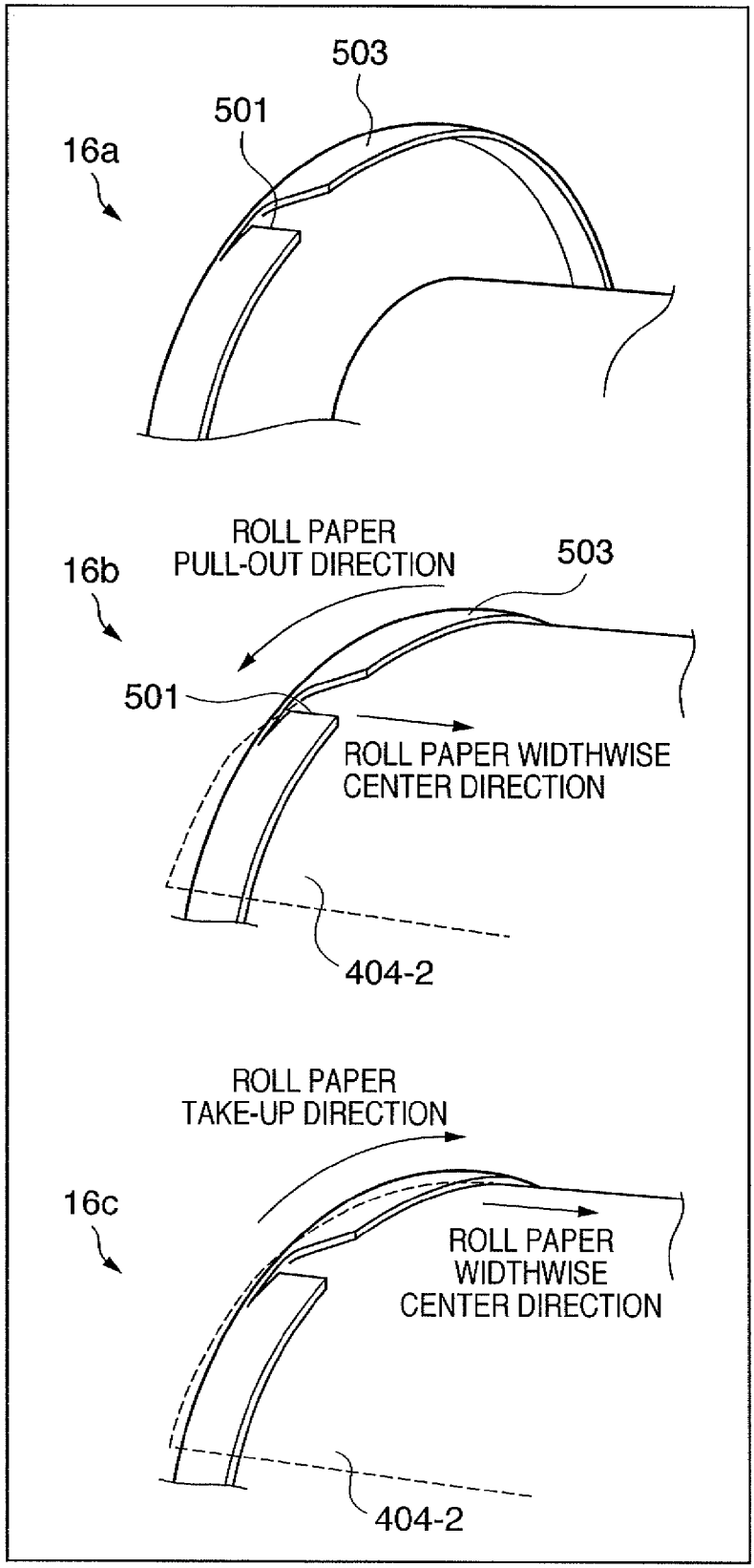
FIG. 16 is a perspective view of the roll paper unit 404.

Each notch 501 has a shape, as shown in 16*a* in FIG. 16. Reference numeral 16*b* in FIG. 16 corresponds to the state shown in 13*a* in FIG. 13A, and 16*c* in FIG. 16 corresponds to that shown in reference numeral 13*b* in FIG. 13.

When the roll paper unit 404 is rotated in the direction to feed out the roll paper from the state shown in 16*b* in FIG. 16, the roll paper 404-2 is peeled by the separation member 406 and the flanges 404-3 are curved. The holding portions 503 of the flanges 404-3 then hold the two ends of the roll paper 404-2, as shown in 16*c* in FIG. 16. Upon further rotating the roll paper unit 404, the roll paper 404-2 is further peeled, and a portion of the roll paper 404-2, the two ends of which are held by the flanges 404-3, is moved. At this time, since the flanges 404-3 are curved and stretched in the widthwise direction of the roll paper, the roll paper 404-2 is biased toward the center in the widthwise direction. With this biasing force, the central portion of the roll paper 404-2 swells, a curl of the roll paper 404-2 is eliminated, thus giving the rigidity in the longitudinal direction to the roll paper 404-2. As a result, the roll paper 404-2 can be stably pulled out from the cartridge 110 while the end face of the roll paper 404-2 in the longitudinal direction is surely in contact with the separation member 406. Since the central portion swells, only the end faces of the roll paper 404-2 in the widthwise direction are brought into contact with the housing of the conveyance path and members which form the conveyance path until the roll paper is discharged from the cartridge 110. Therefore, the photographic printing surface can be protected from any damage.

When the roll paper unit 404 is rotated in a direction to rewind the roll paper from the state shown in 16*c* in FIG. 16, a force acts on the roll paper 404-2 in a direction to wind around the roller 404-1. Then, the roll paper which is fed outside the roll paper unit 404 is gradually pulled into the roll paper unit 404 from the portion, the two ends of which are held by the flanges 404-3. For this reason, the curved portions of the flanges 404-3, which hold the two ends of the roll paper 404-2, move in the direction to feed out the roll paper 404-2. By rotating the roll paper unit 404 in the direction to rewind the roll paper, the portions of the flanges 404-3, which hold the two ends of the roll paper 404-2, move up to the notches 501 of the flanges 404-3. As a result, the notches 501 hold the two ends of the roll paper 404-2. In this case, even when the roll paper unit 404 is rotated in the direction to rewind the roll paper, the roll paper 404-2 is not pulled into the roll paper unit 404, and the notches 501 maintain the holding state of the two ends of the roll paper 404-2. As a result, the roll paper 404-2 is taken up to the outer diameter side (outer circumferential portions) of the holding portions 503 of the flanges 404-3 to have the notches 501 as an origin.

In this manner, the roll paper unit 404 surely holds the two ends of the roll paper 404-2 by the notches 501 upon rewinding the roll paper 404-2 into the roll paper unit 404. Hence, the leading end of the roll paper 404-2 always exists outside the roll paper unit 404. Upon pulling out the roll paper 404-2 again, the roll paper 404-2 can be peeled from the roll paper unit 404 by the separation member 406.

The roll paper unit 404 is designed to rotate only when it is loaded into the printer, so as to prevent inadvertent rotation inside the cartridge 110. This mechanism will be described below with reference to FIGS. 14 and 15.

Figure 14:
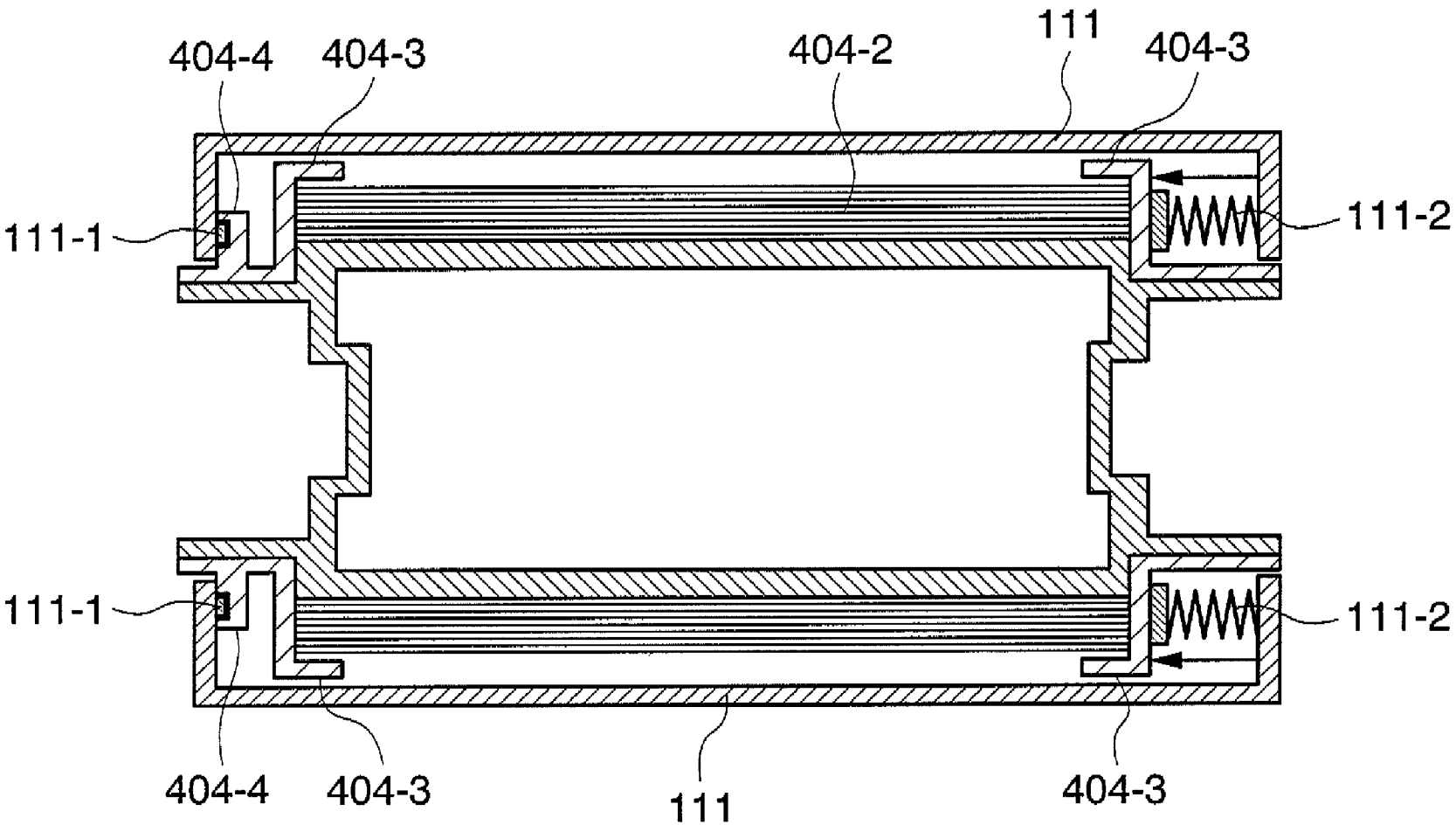
FIG. 14 is a sectional view of the roll paper unit 404.

The state in which the cartridge 110 is not loaded into the printer 100 will be described first with reference to FIG. 14.

Concave engaging portions 404-4 for anti-rotation are formed at one end of the roll paper unit 404. Convex engaging members 111-1, which can engage with the engaging portions 404-4, are formed inside the housing of the cartridge 110. Biasing springs 111-2 are arranged in on the other end side of the roll paper unit 404, and bias the roll paper unit 404 toward the engaging member 111-1. Hence, when the cartridge 110 is not loaded into the printer, the concave and convex shapes of the engaging portions 404-4 and the engaging members 111-1 engage with each other. As a result, the roll paper unit 404 is fixed inside the cartridge, and cannot be rotated.

Figure 15:
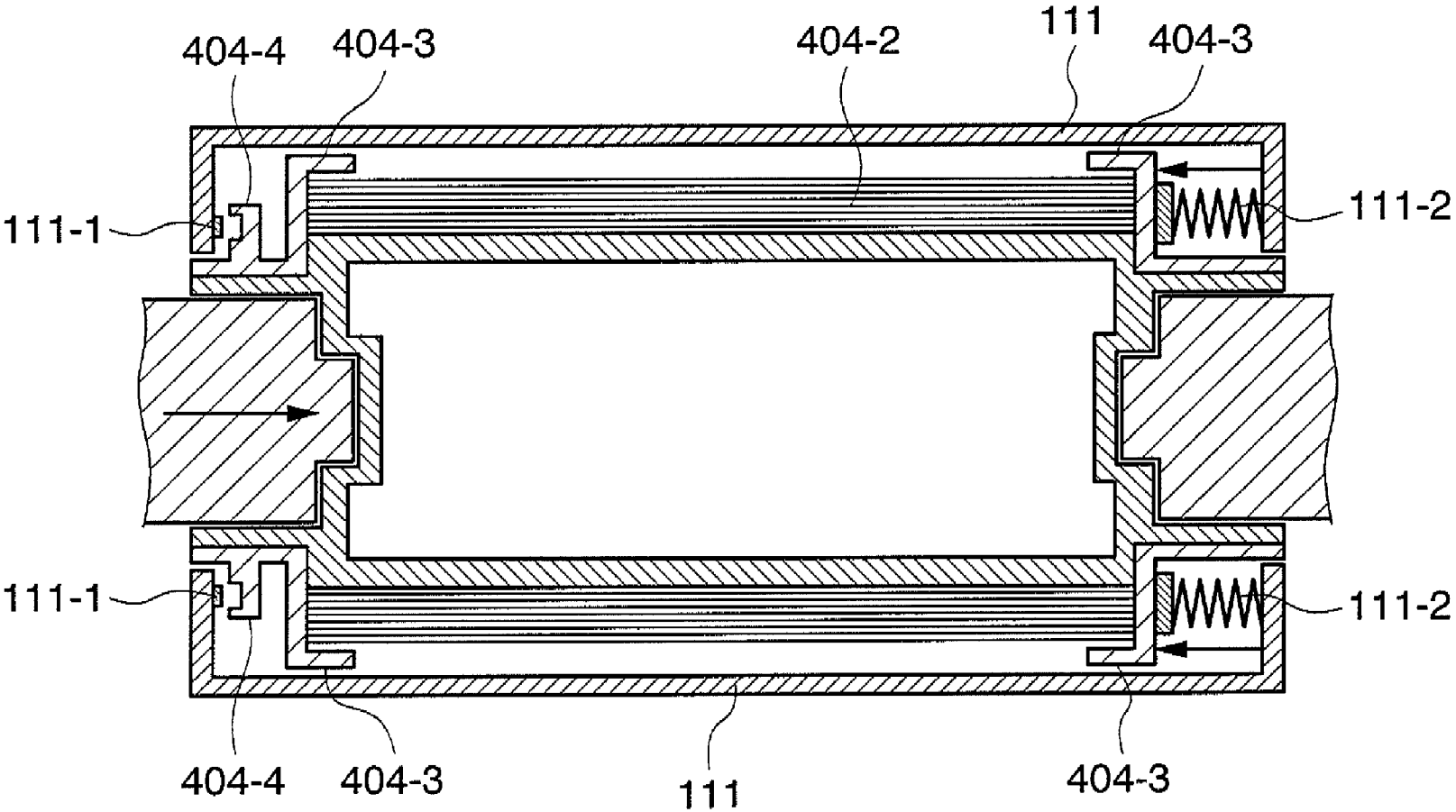
FIG. 15 is a sectional view of the roll paper unit 404.

FIG. 15 shows the state in which the cartridge 110 is loaded into the printer 100. Upon loading the cartridge 110, the rotation shaft of the roller 404-1 engages with that of the printer 100. Upon engaging with the rotation shaft of the roller 404-1, the roll paper unit 404 is biased and moved toward the biasing springs 111-2 side. Since the roll paper unit 404 is moved, the engaging portions 404-4 and engaging members 111-1 disengage from each other to allow the roll paper unit 404 to be rotatable.

With this arrangement, only when the cartridge 110 is loaded into the printer 100, the roll paper unit 404 rotates; when the cartridge 110 is detached from the printer 100, the roll paper unit 404 can be prevented from rotating.

Figure 22:
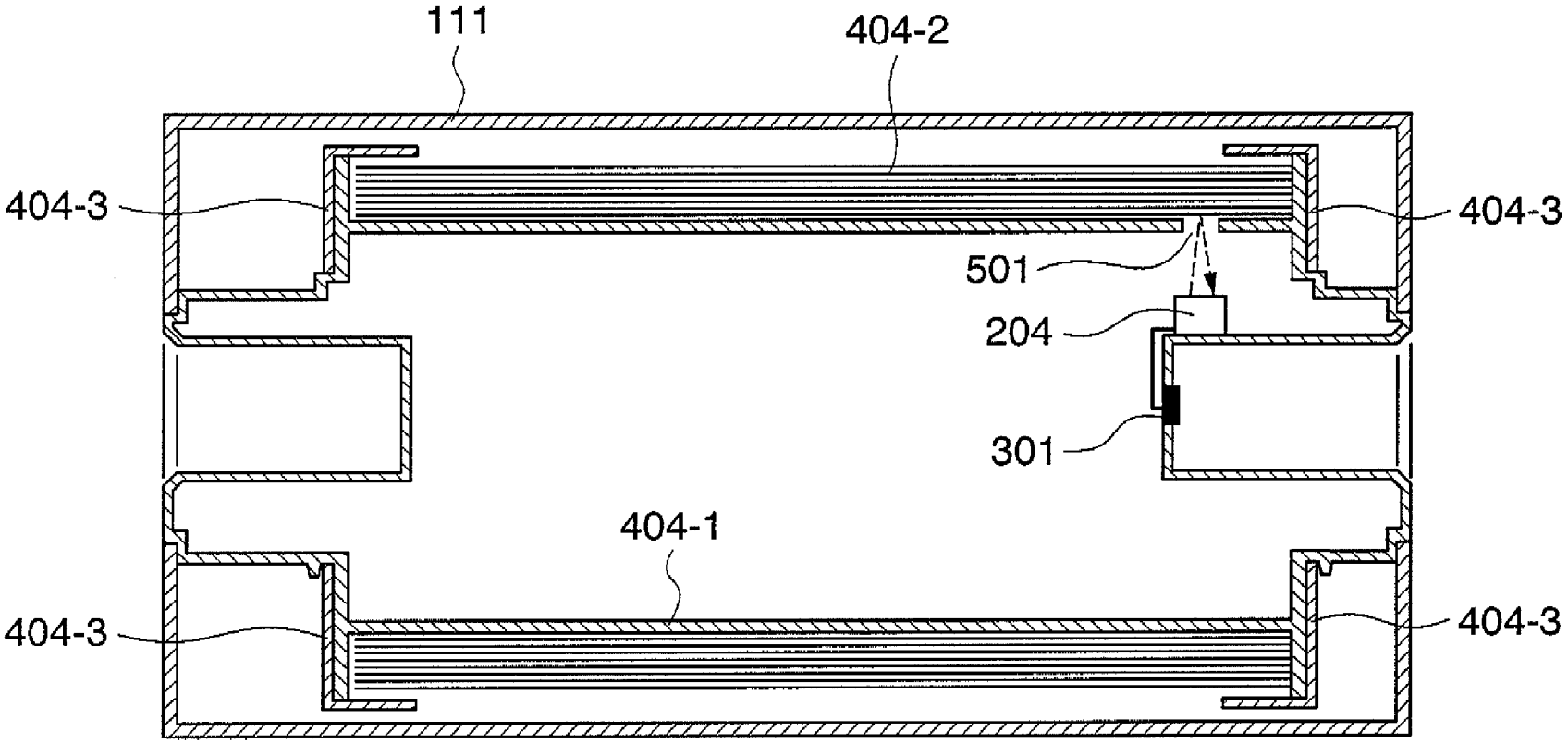
FIG. 22 is a sectional view of the roll paper unit 404 to explain a paper detection mechanism.

FIG. 22 is a sectional view of the roll paper unit 404 to explain a paper detection mechanism. As shown in FIG. 22, the roller 404-1 has a hollow structure to attain weight savings, and the terminal end detection sensor 204 is arranged inside the roller 404-1. The terminal end detection sensor 204 is a reflective photosensor like a photoreflector. The sensor 204 irradiates the roll paper 404-2 with light from the interior of the roller 404-1 via an opening 2201 formed in the roller 404-1, and receives light reflected by the roll paper 404-2. The sensor 204 transmits the reception result to the printer 100 via the contact 301.

Normally, when roll paper is detected from outside the cartridge 110, an opening for sensor irradiation needs to be formed on the housing 111 and the printer 100 side must detect the remaining amount of roll paper inside the housing.

On the other hand, by providing the terminal end detection sensor 204 inside the roller 404-1, no irradiation opening is required to be formed in the housing 111. For this reason, the user never directly touches the roll paper 404-2, and dust and the like can be prevented from entering the housing. In case of roll paper, if the diameter of the roller 404-1 is reduced, crinkles or curls are formed, thus adversely influencing quality. Hence, the roller 404-1 is required to have a certain diameter. For this reason, a space is formed inside the roller 404-1. In the present invention, since the terminal end detection sensor is arranged using the hollow structure of the roller 404-1, the printer 100 can be made more compact than the case in which the terminal end detection sensor is provided to the printer 100 side.

Furthermore, when the terminal end detection sensor is arranged on the printer 100 side to irradiate the roll paper 404-2 with light from outside the roll paper 404-2, the distance between the terminal end detection sensor and the irradiated position of the roll paper 404-2 changes as the roll paper 404-2 is consumed.

By contrast, when the terminal end detection sensor 204 is arranged inside the roller 404-1, and irradiates the inner side of the roll paper 404-2 with light, the distance between the terminal end detection sensor 204 and the irradiated position of the roll paper 404-2 becomes constant irrespective of the amount of consumption of the roll paper 404-2. Furthermore, since the terminal end of the roll paper 404-2 is fixed to a portion of the roller 404-1, the distance between the terminal end detection sensor 204 and roll paper 404-2 can be kept constant. As a result, the presence/absence of the roll paper 404-2 can be reliably detected, and detection errors can be avoided.

4. Arrangement Inside Printer while Cartridge is Loaded

Figure 6:
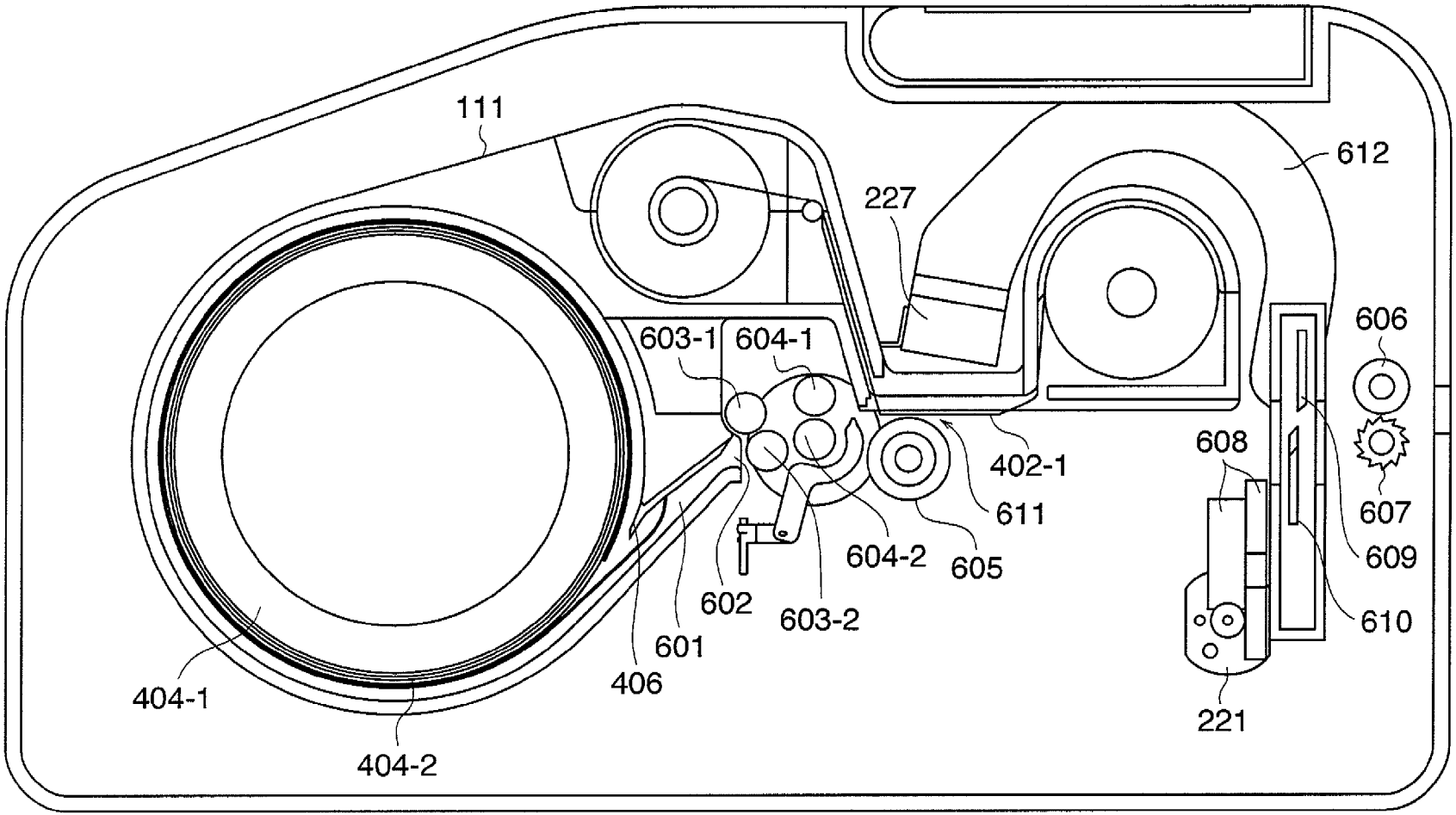
FIG. 6 is a side sectional view of a state in which the cartridge 110 is loaded into the printer 100 when viewed from the side surface of the printer 100.

FIG. 6 is a sectional view showing the loading state of the cartridge 110 into the printer 100 when viewed from the side surface of the printer 100. The arrangement of the respective units which operate upon execution of the printing processing of the printer 100 will be briefly described below with reference to FIG. 6. Note that the same reference numerals denote the components which have already been described in the above explanation, and a description thereof will not be repeated.

Referring to FIG. 6, reference numeral 601 denotes a conveyance path through which the roll paper 404-2 included in the cartridge 110 passes when it is pulled out to a photographic printing position 611 upon photographic printing. Reference numeral 602 denotes a cartridge exit. The roll paper 404-2 wound around the roller 404-1 is peeled by the separation member 406, is pulled outside the cartridge 110 via the cartridge exit 602, and passes through the convey path 601.

Reference numerals 603-1 and 603-2 respectively denote an uncurl roller and a driven uncurl roller, which are used to uncurl the roll paper 404-2. Reference numerals 604-1 and 604-2 respectively denote a grip roller and pinch roller, which are arranged at opposing positions via the roll paper 404-2, and clamp the obverse and reverse surfaces of the roll paper 404-2. Upon rotating one pair of these rollers (first convey unit) in a normal direction (upon rotating the grip roller 604-1 counterclockwise with respect to the sheet surface), the roll paper 404-2 pulled out from the cartridge 110 is conveyed toward the photographic printing position 611.

In the state in which the cartridge 110 is loaded into the printer 100, the housing of the cartridge 110 which covers the ink ribbon 402-1 at a position corresponding to the photographic printing position 611 is removed. Then, the ink ribbon 402-1 exposes outside the cartridge 110.

Reference numeral 605 denotes a platen roller, which maintains the superposed state of the ink ribbon 402-1 and roll paper 404-2 at the photographic printing position 611 between itself and the thermal head 227.

Reference numeral 606 denotes a discharge roller, which conveys the roll paper 404-2 in a discharge direction. Reference numeral 607 denotes a discharge kick-out roller, which has a gear portion and kicks out a cut sheet that has undergone the photographic printing of the roll paper 404-2 into a discharge box (not shown). The discharge roller 606 and discharge kick-out roller 607 (second conveyance unit) are arranged at opposing positions via the roll paper 404-2, and clamp the obverse and reverse surfaces of the roll paper 404-2.

Reference numeral 608 denotes a gear train which transmits the operation of the cutter motor 221 to the cutter unit. Reference numerals 609 and 610 respectively denote a cutter blade and a cutter bed blade which form the cutter unit, and are arranged at opposing positions via the conveyance path of the roll paper 404-2. The cutter blade 609 and cutter bed blade 610 are driven by the gear train 608 and the upper and lower blades rub up each other like scissors, thereby cutting the roll paper 404-2.

Note that the leading end of the roll paper 404-2 is peeled by the separation member 406, and stays in the conveyance path 601 in FIG. 6. However, in the printer 100, this state is not realized immediately after the cartridge 110 is loaded into the printer 100.

The operation of the roll paper unit 404 from when the cartridge 110 is loaded until the leading end of the roll paper 404-2 is peeled by the separation member 406 and stays in the conveyance path 601 (state of FIG. 6) will be briefly described below.

Figure 17:
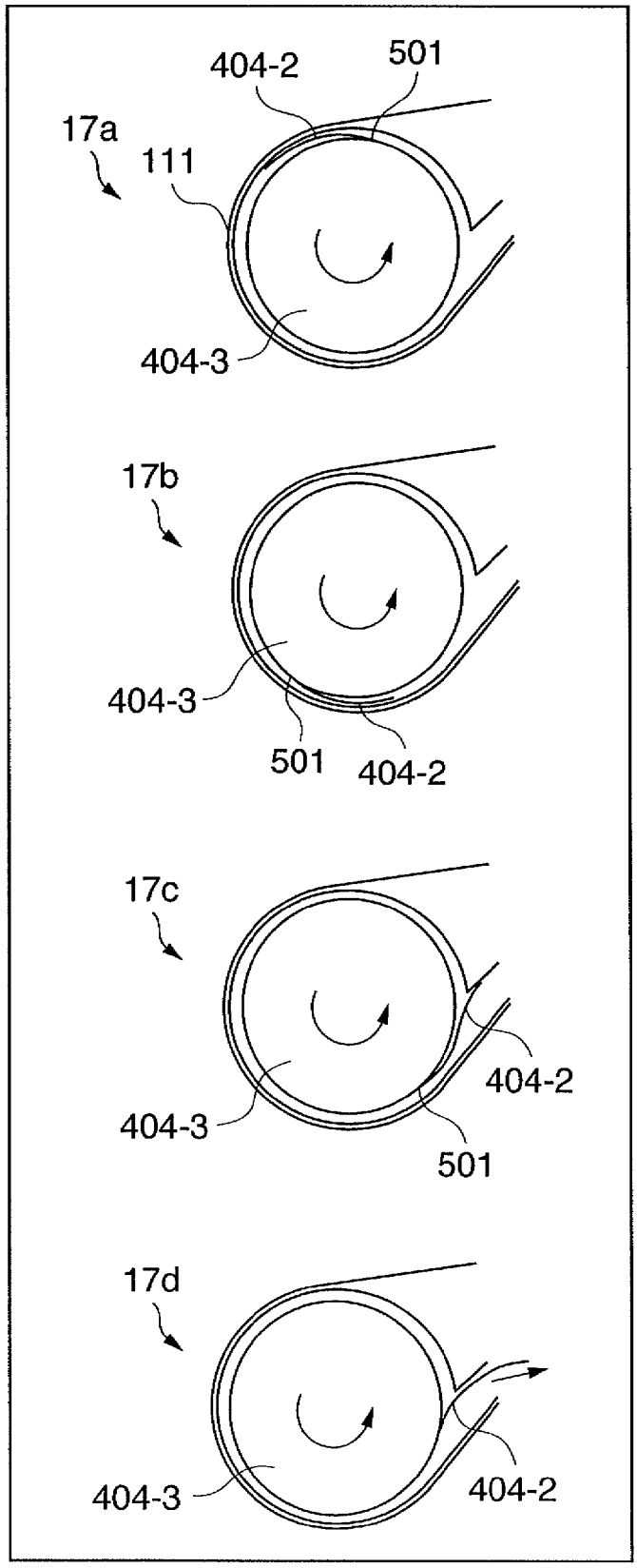
FIG. 17 is a schematic view showing the states of the roll paper unit 404 of the cartridge 110.

Reference numerals 17*a* to 17*d* in FIG. 17 are schematic views showing the states of the roll paper unit 404 immediately after the cartridge 110 is loaded into the printer 100. When the cartridge 110 is loaded into the printer 100, since the rotation shaft of the roller 404-1 is coupled to the rotation mechanism of the printer 100, the rotation of the roller 404-1 is controlled by the printer 100.

Reference numeral 17*a* in FIG. 17 shows the state immediately after the cartridge 110 is loaded. When the cartridge 110 is loaded, and the conveyance operation of the roll paper starts, the rotation mechanism of the printer 100 applies a rotation driving force to the roller 404-1 to rotate the roll paper unit 404 (17*a*→17*b*). After the roll paper unit 404 is rotated, the leading end of the roll paper 404-2 is brought into contact with the separation member 406, as shown in reference numeral 17*c* in FIG. 17. The roll paper 404-2 is peeled from the separation member 406 and is guided toward the cartridge exit direction (17*d*).

In this way, the roll paper 404-2 is pulled out from the roll paper unit 404 and cartridge 110. When the rotation of the roller 404-1 is stopped in the state of 17*d*, the leading end of the roll paper 404-2 is peeled and stays in the conveyance path 601. That is, the state shown in FIG. 6 is realized.

In this state, by rotating the roll paper unit 404, the roll paper 404-2 can be conveyed in the feeding direction of the roll paper.

5. Overall Sequence of Printing Processing

Figure 8:
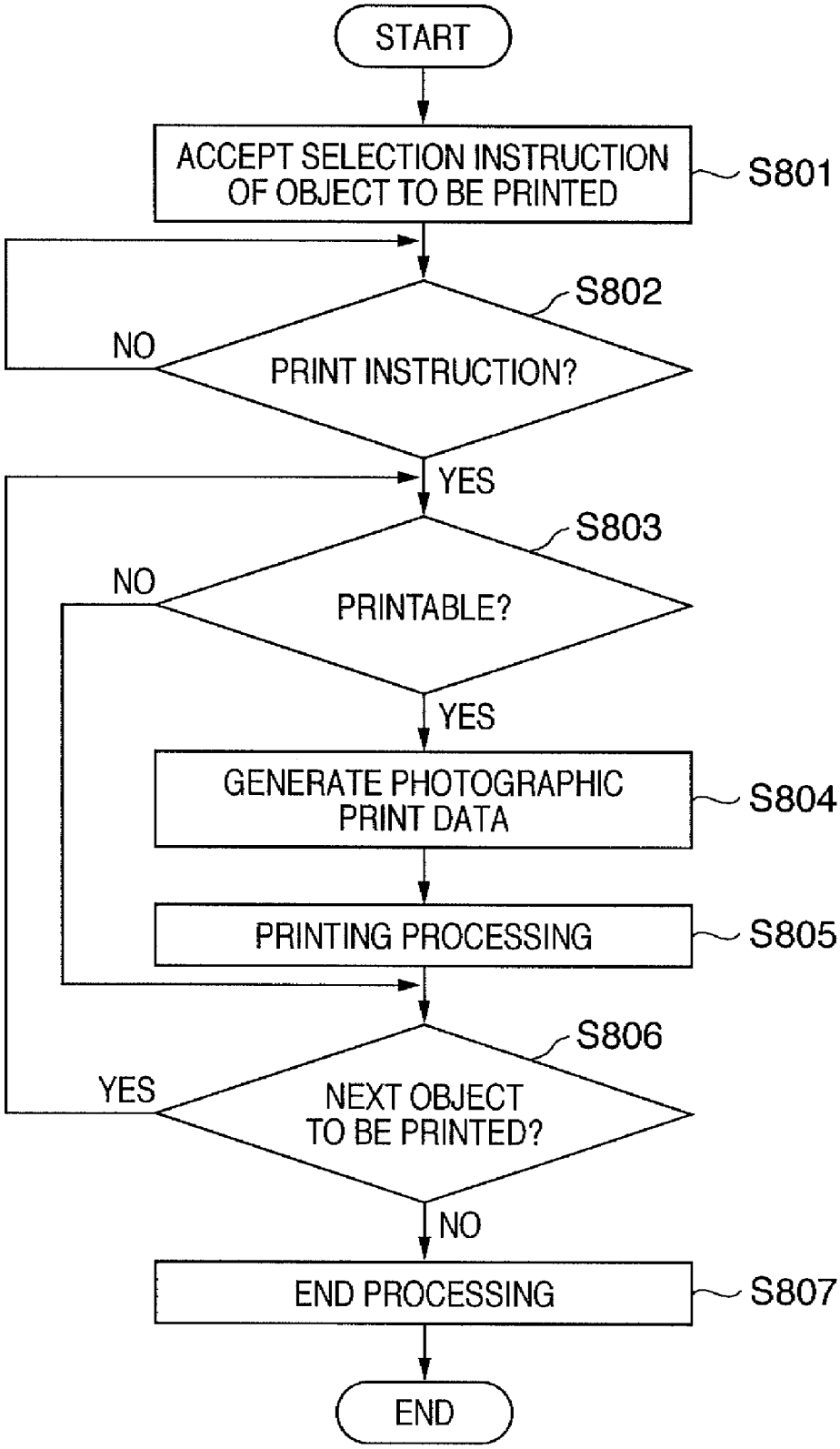
FIG. 8 is a flowchart showing the overall sequence of printing processing in the printer 100.

The overall sequence of the printing processing in the printer 100 will be described below with reference to FIG. 8. FIG. 8 is a flowchart showing the overall sequence of the printing processing in the printer 100. After the cartridge 110 is loaded into the printer 100 and the power supply is turned on, when the state shown in FIG. 6 is realized, and when the reading of information of the IC arranged in the cartridge 110 is complete, and import of image data to be printed is complete, the processing shown in FIG. 8 starts.

In step S801, information associated with image data selected as an object to be printed by the user via the console 103 from those displayed on the display unit 102 is accepted. Note that the number of image data which can be selected as an object to be printed is not limited to one, but a plurality of image data may be selected.

It is checked in step S802 if the user issues a print instruction via the console 103. If it is determined in step S802 that the user issues a print instruction, the process advances to step S803.

It is checked in step S803 if the printer is ready to print. In this step, whether or not full image data selected in step S801 is printable is checked based on the remaining amount of the roll paper 404-2. Note that the remaining amount of the roll paper 404-2 is calculated based on the detection result of the terminal end detection sensor 204.

If it is determined in step S803 that the printer is not ready to print, a message that advises accordingly is displayed on the display unit 102, and the process jumps to step S806.

On the other hand, if it is determined in step S803 that the printer is ready to print, the process advances to step S804, and photographic printing data (rendering data) for respective colors are generated based on the selected image data.

In step S805, the printing processing is executed using the generated photographic printing data. Note that details of the printing processing will be described later.

It is checked in step S806 if there is the next image data selected as an object to be printed. If it is determined in step S806 that there is the next image data selected as an object to be printed, the process returns to step S803 to repeat the processes.

On the other hand, if it is determined in step S806 that there is no next image data selected as an object to be printed, or if it is determined in step S803 that the printer is not ready to print, the process advances to step S807.

In step S807, end processing is executed to restore the state shown in FIG. 6. More specifically, the thermal head 227 is returned to the escape position, and the roll paper 404-2 is taken up, so that the leading end of the roll paper 404-2 is located on the conveyance path 601.

6. Operation Upon Execution of Printing Processing

The operation of the printer 100 upon execution of the printing processing in step S805 will be described in detail below with reference to the drawings.

6.1 Pulling Out Roll Paper

When the roller 404-1 which pivots integrally with the roll paper 404-2 is driven (counterclockwise with respect to the plane of paper) in the state shown in FIG. 6, the roll paper 404-2 pivots. When the roll paper 404-2 turns, the roll paper 404-2, which is wound around the roller 404-1, is peeled in turn by the separation member 406, and is fed out onto the conveyance path 601. As a result, the leading end of the roll paper 404-2 is discharged from the cartridge exit 602.

The roll paper detection sensors 205 (not shown in FIG. 6) are arranged in the vicinity of the cartridge exit 602, and are arranged to oppose each other to have a sufficient distance with respect to the width of the roll paper 404-2.

With this arrangement, when the roll paper 404-2 is discharged from the cartridge exit 602, the degree of skew of the discharged roll paper 404-2 can be detected based on the difference between the detection timings of the roll paper detection sensors 205.

If the detected skew is equal to or larger than an allowance, the pulling-out operation is interrupted, and a warning is displayed on the display unit 102. When the roll paper 404-2 is pulled out while being skewed, the skew at that time worsens while the roll paper is conveyed inside the printer 100. As a result, accurate photographic printing cannot be attained. In the worst case, the roll paper 404-2 may fall outside its conveyable width allowed inside the printer 100.

6.2 Uncurling Roll Paper

The roll paper 404-2 pulled out from the cartridge exit 602 is guided to the uncurl roller 603-1, and is uncurled.

The uncurl roller 603-1 is made up of soft rubber, and is in pressure contact with the hard uncurl driven roller 603-2 which is arranged at the opposing position. The roller 603-1 deforms the roll paper 404-2 to bend its traveling direction through about 90°.

With this arrangement, the roll paper 404-2 is pressed in a direction opposite to the winding direction on the roller 404-1 to eliminate a curl formed since it has been wound around the roller 404-1. Note that uncurling is not limited to such specific arrangement but may be realized by other arrangement. For example, the roll paper 404-2 may be uncurled by passing it through hard wall-shaped members, or may pass through a plurality of uncurl rollers in a zigzag pattern to attain uncurling.

Note that the uncurl roller 603-1 escapes from the driven uncurl roller 603-2 upon pulling out the roll paper 404-2. At the timing when the roll paper 404-2 is pulled out to the position of the uncurl roller 603-1, the uncurl roller 603-1 is brought into pressure contact with the driven uncurl roller 603-2 to clamp the roll paper 404-2.

6.3 Cueing Roll Paper

After uncurling, the roll paper 404-2 is conveyed by the uncurl roller 603-1 and reaches a grip roller unit.

The grip roller unit comprises the grip roller 604-1 and pinch roller 604-2. Before the roll paper 404-2 reaches the grip roller unit, the grip roller 604-1 escapes from the pinch roller 604-2. At the timing when the roll paper 404-2 is conveyed to the position of the grip roller unit, the grip roller 604-1 is brought into pressure contact with the pinch roller 604-2, and clamps the roll paper 404-2.

Fine projecting pawls are formed on the surface of the grip roller 604-1, and bite on the reverse surface of the roll paper 404-2, thus gripping the roll paper 404-2.

Figure 9:
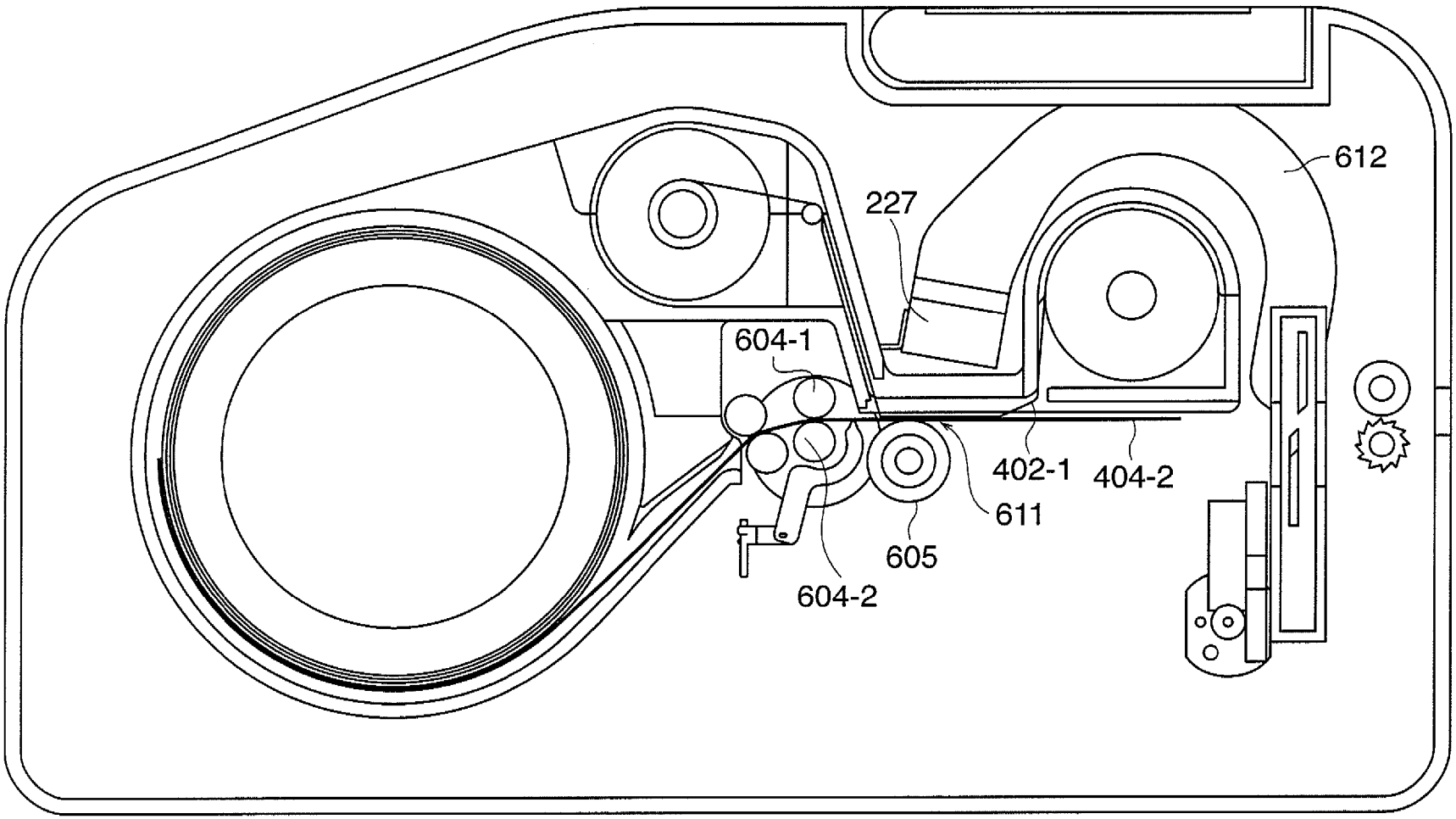
FIG. 9 is a view for explaining the operation of the printer 100 upon printing processing.

The roll paper 404-2 gripped by the grip roller unit is further conveyed, and passes through a nip between the thermal head 227 and the platen roller 605 arranged to oppose the thermal head 227 (see FIG. 9).

The roll paper cue sensor 206 (not shown in FIG. 9) is arranged behind the platen roller 605, and is turned on when the leading end of the roll paper 404-2 passes through the nip between the thermal head 227 and platen roller 605.

Upon reception of the ON signal of the roll paper cue sensor 206, the main controller 201 calculates a distance required to convey the roll paper 404-2. The roll paper 404-2 is conveyed by the grip roller 604-1 controlled based on the calculation result, and stops when it reaches a predetermined position (photographic printing start position) (completion of cueing of the roll paper 404-2). In this way, the roll paper required to print one image is pulled out from the cartridge 110, and stands by at the photographic printing start position.

6.4 Photographic Printing Operation 6.4.1 Head Down

Upon completion of cueing of the roll paper 404-2, the ink ribbon 402-1 housed in the cartridge 110 is taken up. The ink ribbon 402-1 is taken up via the ribbon take-up motor 217 arranged in the printer 100 and a gear train connected to that motor.

On the ink ribbon 402-1, identification bands are applied in the widthwise direction of the ink ribbon 402-1 at cue positions of respective Y, M, and C surfaces, and an overcoat layer. Note that, in particular, an identification band of a different color is applied to the head portion of the first Y surface serving as a reference for printing.

In this embodiment, two identification bands are applied to the head portion of the Y surface to be distinguished from the head portions of other colors each having one identification band. Such difference is identified by the ribbon cue sensor 207, and the identification result is transmitted to the main controller 201, which can recognize the first surface of photographic printing.

When the ribbon cue sensor 207 identifies that the two identification bands are applied, the main controller 201 stops the ink ribbon take-up motor 217. At the same time, the main controller 201 drives the head up-down motor 219 to move the thermal head upward or downward to turn the thermal head 227 to the photographic printing position 611.

Figure 10:
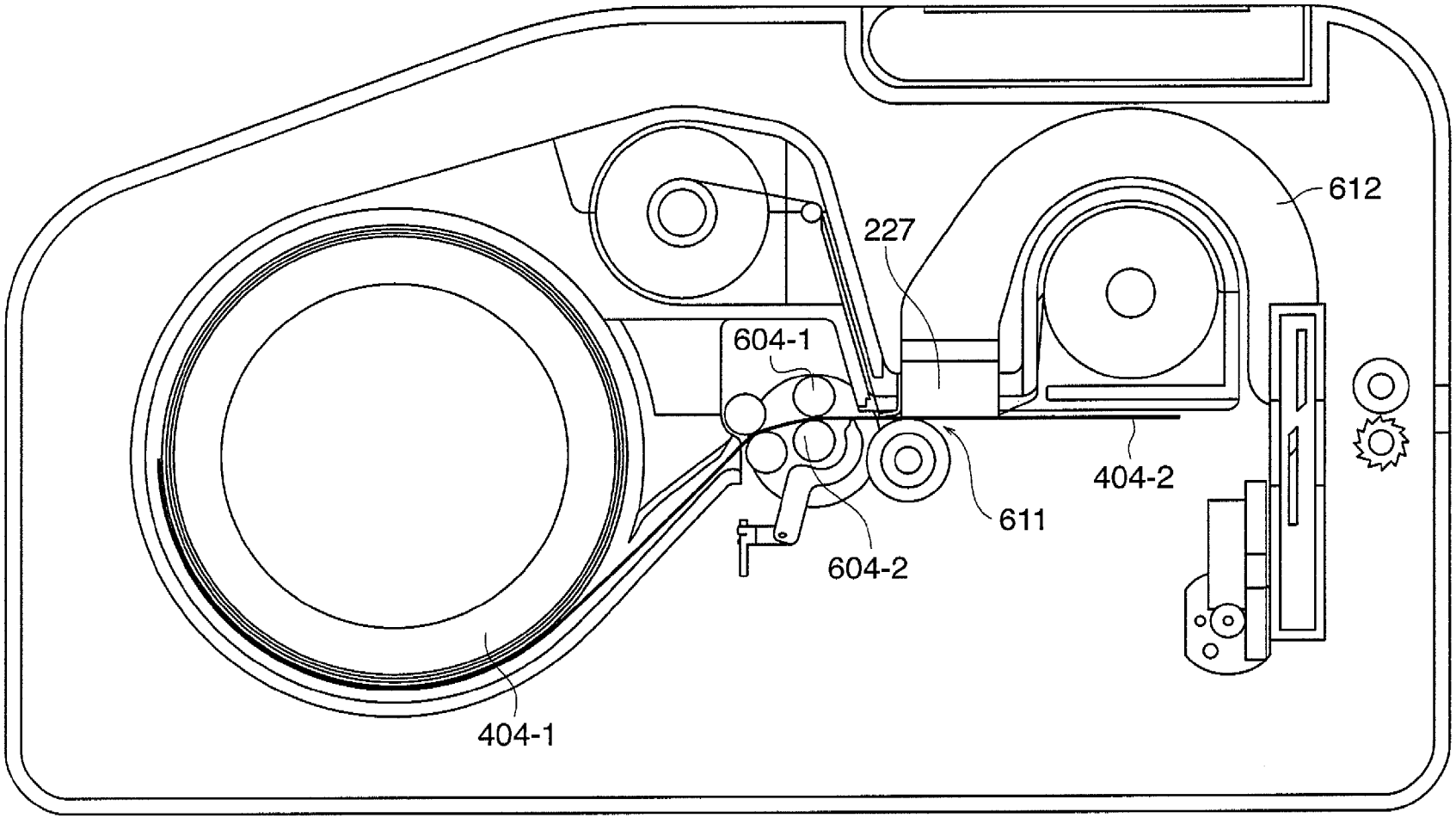
FIG. 10 is a view for explaining the operation of the printer 100 upon printing processing.

The thermal head 227 is pivotally arranged on a base of the printer 100 via a head lever 612, and the head up-down motor 219 drives the head lever 612 to turn the thermal head 227 to the photographic printing position 611 (see FIG. 10).

The base of the printer 100 has support portions which support the pivot center of the head lever 612, the rotation center of the grip roller unit, and that of the platen roller 605, and these members form a unit. The correlation among the dimensions of these members largely influences the photographic printing performance, and since these members form a unit, stable head touch is attained compared to a case in which these members are independently arranged.

6.4.2 Disabling Uncurling

When the thermal head 227 has turned to the predetermined photographic printing position 611, the uncurl roller 603-1 escapes from the driven uncurl roller 603-2 to disable uncurling. This is to prevent an excessive load from being imposed on the roll paper 404-2 during the photographic printing operation.

6.4.3 Photographic Printing

When the thermal head 227 has reached the photographic printing position 611, the grip roller 604-1 starts to reciprocally convey the roll paper, thus starting photographic printing.

When the roll paper 404-2 wound around the roller 404-1 is conveyed in the opposite direction by the grip roller 604-1, it returns into the cartridge 110. At this time, the feeding motor 215 operates to turn the roll paper unit 404 in a direction (reverse convey direction) opposite to the rotation direction upon pulling out the roll paper 404-2 before the beginning of printing. The operation of the roll paper unit 404 inside the cartridge 110 and the roll paper 404-2 will be described below with reference to 18*a* to 18*e* in FIG. 18.

Figure 18:
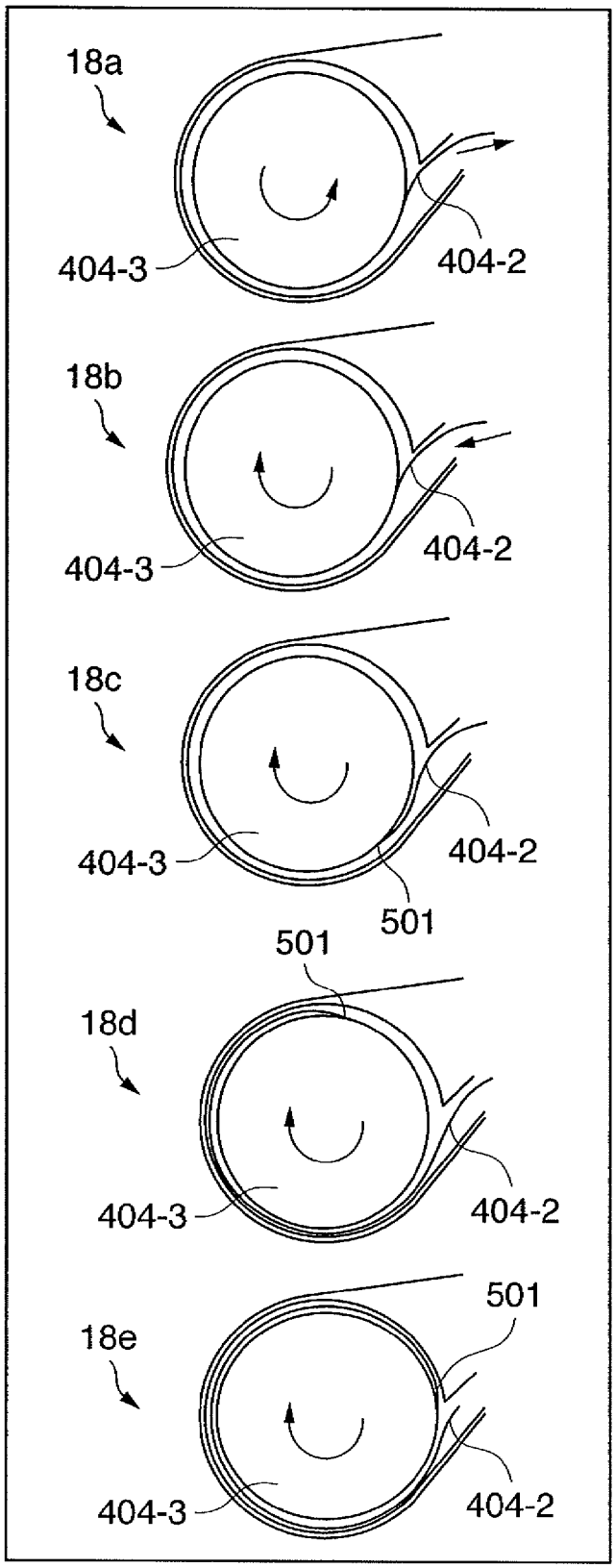
FIG. 18 is a schematic view showing the states of the roll paper unit 404 of the cartridge 110.

Before the beginning of printing, the roll paper 404-2 is pulled out from the cartridge 110 by rotating the roll paper unit 404 in the conveyance direction, as shown in 18*a* in FIG. 18.

Upon taking up the roll paper 404-2 into the cartridge 110, the roll paper unit 404 is rotated in a rewind direction opposite to the conveyance direction, as shown in 18*b* in FIG. 18. Upon rotation in the rewind direction, as described above, the roll paper 404-2 pulled out from the roll paper unit 404 is taken up into the roll paper unit while deforming the holding portions 503 of the flanges, as described above. When the roll paper 404-2 held by the holding portions 503 reaches the notches 501, as shown in 18*b* in FIG. 18, it is gripped by the notches 501 and is no longer pulled into the roll paper unit 404.

In other words, upon rewinding the roll paper 404-2, the roll paper 404-2 is taken up into the roll paper unit 404 until the state of 18*b* in FIG. 18 is reached. However, at this time, the roll paper 404-2 of a sufficient length has already been pulled out from the cartridge 110. That is, the roll paper 404-2 with a length larger than the outer circumference of the roll paper unit 404 has already been pulled out from the cartridge 110. For this reason, the roll paper 404-2 is never completely pulled into the roll paper unit 404. Note that rewinding may be controlled after it is confirmed that the roll paper 404-2 with a length larger than the outer circumference of the roll paper unit 404 has already been pulled out from the cartridge 110.

When the roll paper unit 404 is further rotated from the state of 18*b* in FIG. 18, the roll paper 404-2 is taken up on the outer diameter side (outer circumferential portions) of the holding portions 503 of the flanges 404-3 to have the notches 501 as an origin (18*c*→18*d*). Since the roll paper 404-2 is taken up using the outer diameters of the flanges 404-3, the roll paper 404-2 can be stably conveyed.

Even when the roll paper unit 404 is rotated inside the cartridge 110 upon detaching the cartridge 110 from the printer 100, it is rotated while the roll paper 404-2 is kept wound around the holding portions 503 of the flanges 404-3. For this reason, the leading end of the roll paper 404-2 can be prevented from being pulled into the roll paper unit 404.

After the photographic printing of the first color (Y), when that of the second color (M) starts, the roller 404-1 and flanges 404-3 are rotated in the forward direction to discharge the roll paper 404-2 wound around the holding portions 503 from the cartridge 110 again. Such a roll paper conveyance operation is repeated for respective colors (Y, M, C, and overcoat).

Note that the feeding motor 215 has a clutch mechanism having a slip torque. With this arrangement, upon operation in a direction to feed out the roll paper 404-2, the full force from the feeding motor 215 acts; upon operation in a direction to rewind the roll paper 404-2, the motor 215 operates with a predetermined slip torque.

With this arrangement, upon rewinding the roll paper 404-2 during the photographic printing operation, the roll paper 404-2 can be rewound without imposing an excessive stress to a pulled-out portion by the grip roller unit.

Note that the take-up length of the ink ribbon 402-1, the rewind length of the roll paper 404-2, the conveyance distance of the roll paper 404-2 by the grip roller unit upon photographic printing are controlled to have the detection timing of each identification band applied to the ink ribbon 402-1 as a photographic printing start reference.

For example, when a cartridge 110 for a postcard size is loaded, the control is made to execute photographic printing by about 150 mm from the photographic printing start reference. On the other hand, when a cartridge 110 for an L size is loaded, the control is made to execute photographic printing by about 127 mm from the photographic printing start reference. Hence, a range according to each size can undergo photographic printing.

Note that the type of the loaded cartridge can be recognized when the IC read/write unit 230 reads out information of the IC arranged in the cartridge 110.

6.4.4 Improving Write Image Quality

During the photographic printing operation, energy to be applied to the thermal head 227 is adjusted using the manufacture information (e.g., density information) of the ink ribbon 402-1 read out from the IC arranged in the cartridge 110.

The main controller 201 acquires the ambient temperature of the use environment from the ambient temperature sensor 208 equipped in the printer 100, and calculates optimal input energy from the ambient temperature and the manufacture information of the ink ribbon 402-1. The main controller 201 then adjusts the energy to be applied to the thermal head 227 based on the calculation result.

More specifically, when the ambient temperature is low, since the temperature of the thermal head 227 is not so high particularly immediately after the beginning of photographic printing, a photographic printing result tends to have a lower density near the photographic printing start position on the roll paper 404-2. For this reason, the image quality of the roll paper 404-2 immediately after the beginning of photographic printing becomes nonuniform near the end portion (the end portion on the side cut by the cutter unit).

To avoid such a situation, the printer 100 of this embodiment improves the image quality near the cut surface by storing residual heat immediately before the beginning of photographic printing or inputting heat energy that considers information of the temperature characteristics of the ink ribbon 402-1.

6.4.5 Operation For Photographic Printing Terminal End

Immediately after the photographic printing terminal end (i.e., the leading end of the roll paper 404-2) has passed through the heating element of the thermal head 227, the photographic printing operation (heating operation) still continues.

For this reason, when the thermal head 227 drops from the leading end of the roll paper 404-2 together with the head lever 612 and is brought into contact with the platen roller 605 as a rubber member, it may deform or melt the platen roller 605.

Hence, in this embodiment, the thermal head 227 is prevented from moving in the pressing direction of the platen roller 605 by the thickness or larger of the roll paper 404-2. However, a method of avoiding deformation or the like of the platen roller 605 is not limited to such specific method. For example, the head pressure detection sensor 209 may detect a change in pressure when the leading end of the roll paper 404-2 has left from the thermal head 227 to stop energy to be input to the thermal head 227.

6.4.6 Completion of Photographic Printing

After execution of the photographic printing operation by a predetermined length from the photographic printing start reference, the take-up operation of the ink ribbon 402-1 and the rewind operation of the roll paper 404-2 are stopped, and the conveyance operation of the roll paper 404-2 by the grip roller 604-1 is stopped.

6.4.7 Feeding Out in Discharge Direction

Upon completion of photographic printing on the roll paper 404-2, the head up-down motor 219 is driven to turn the head lever 612, and to evacuate the thermal head 227 integrally fixed to the head lever 612 to a predetermined escape position. At this time, the ink ribbon 402-1 is taken up by a small amount to pick up the slack of the ink ribbon 402-1.

Next, the roll paper 404-2 is conveyed to the photographic printing start position. At this time, the roll paper 404-2 is conveyed by a conveyance distance upon photographic printing.

When the photographic printing start position is reached, a similar photographic printing operation starts for M ink. After the photographic printing operation for M ink, the same processes are repeated for C ink and overcoat. That is, one complete image is generated by four reciprocal convey operations for Y, M, C, and overcoat.

6.5 Cutting and Discharge Operations 6.5.1 Conveying to Cutting Position

Figure 11:
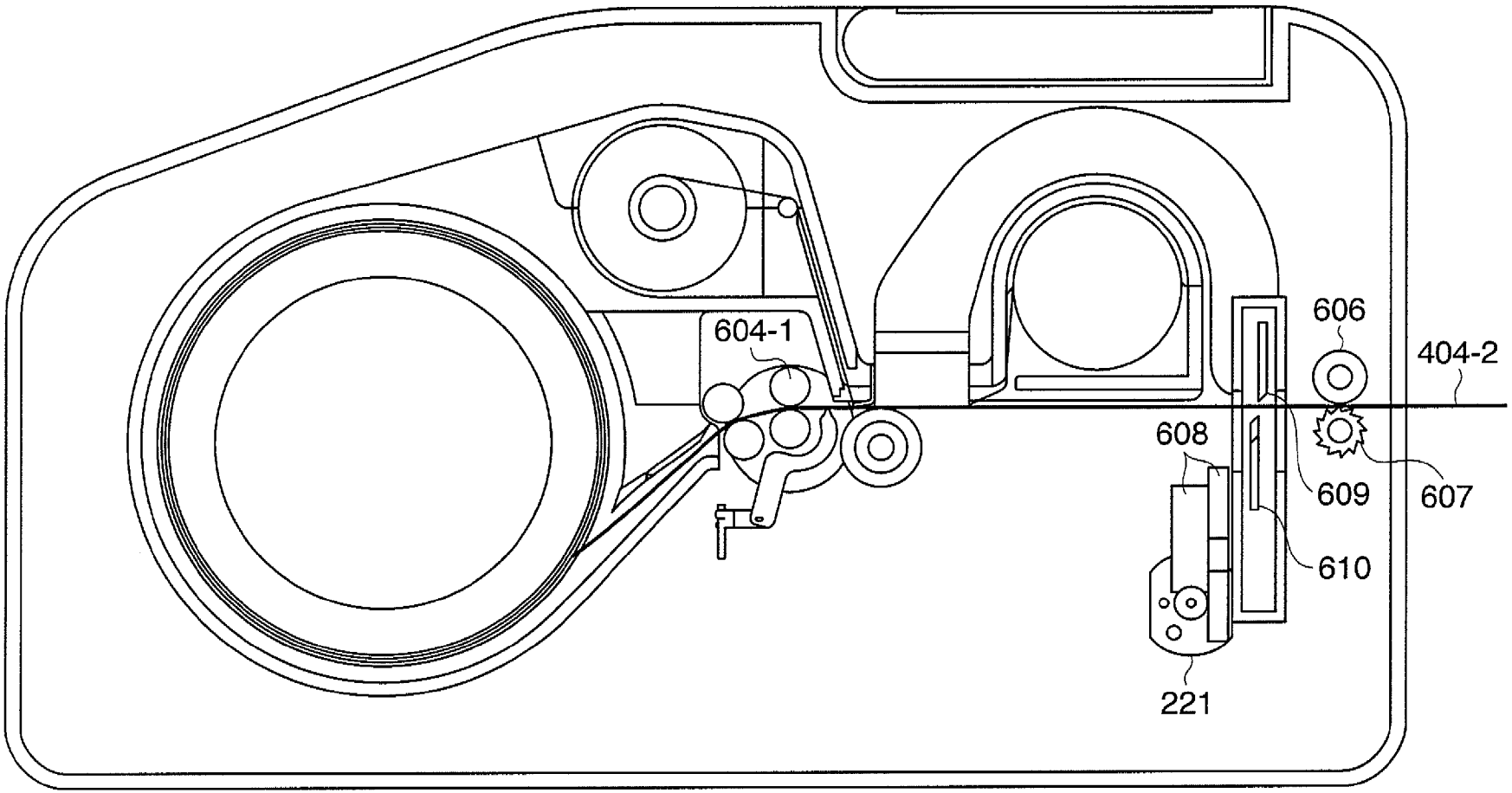
FIG. 11 is a view for explaining the operation of the printer 100 upon printing processing.

Upon completion of overcoat processing, the roll paper 404-2 is conveyed to the cutting position (see FIG. 11). The operations after completion of the overcoat processing until the roll paper 404-2 is conveyed to the cutting position will be described below with reference to FIGS. 19 to 21.

Figure 19:
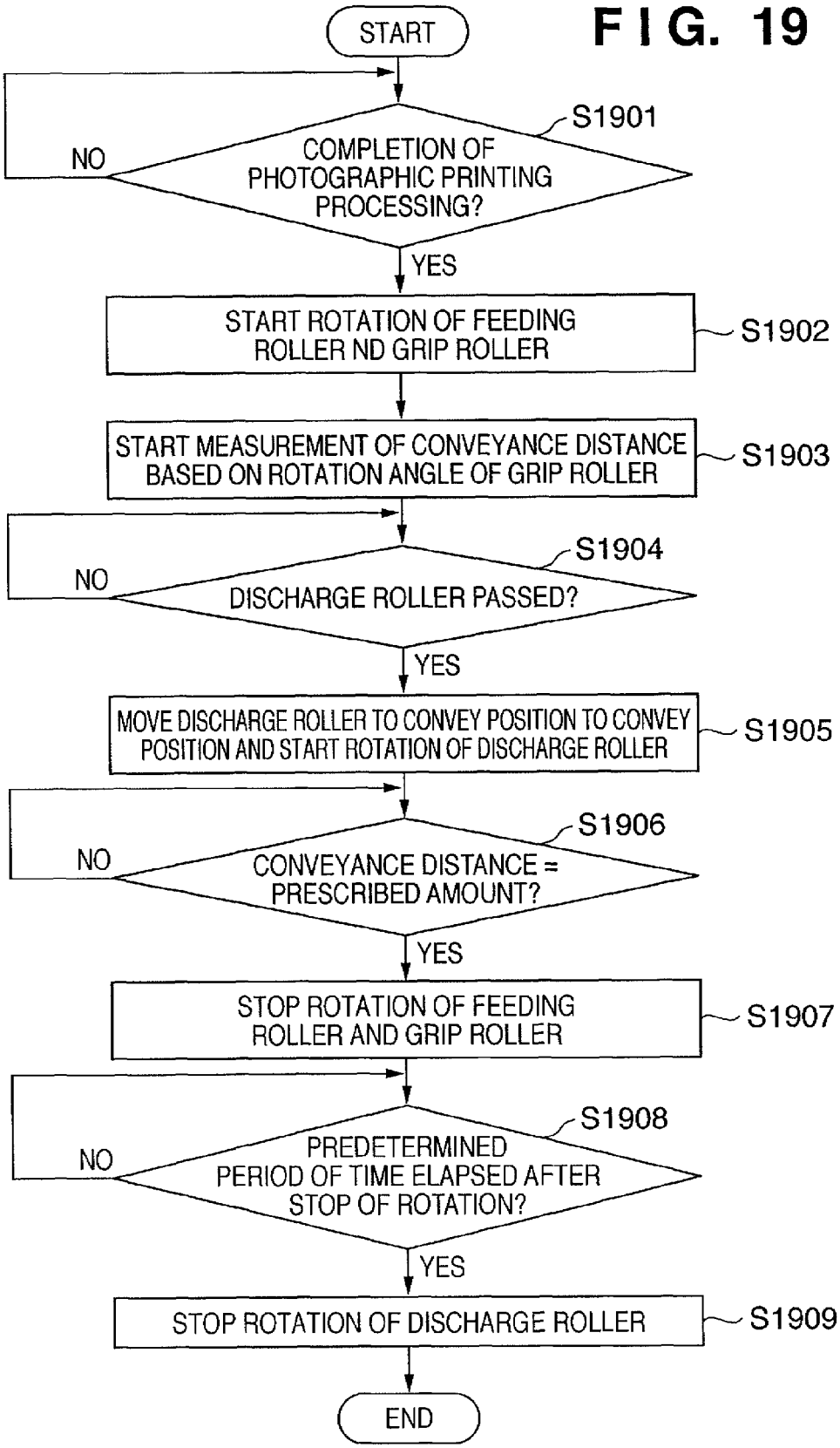
FIG. 19 is a flowchart showing the sequence of the operations of respective units of the printer 100 from completion of overcoat processing until roll paper 404-2 is conveyed to a cutting position.
Figure 20:
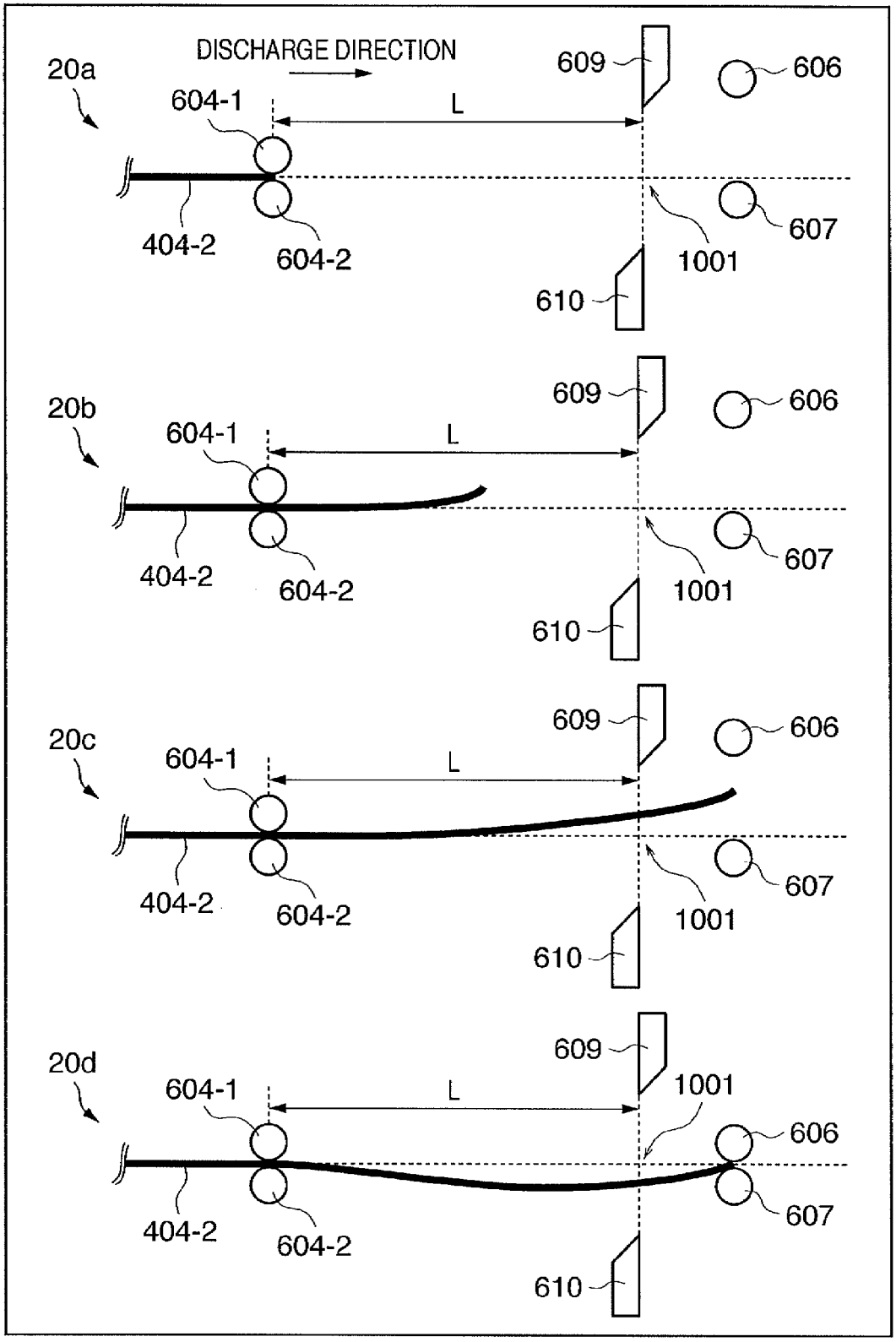
FIG. 20 is a schematic view showing the operations of the respective units of the printer 100 from completion of overcoat processing until the roll paper 404-2 is conveyed to a cutting position.
Figure 21:
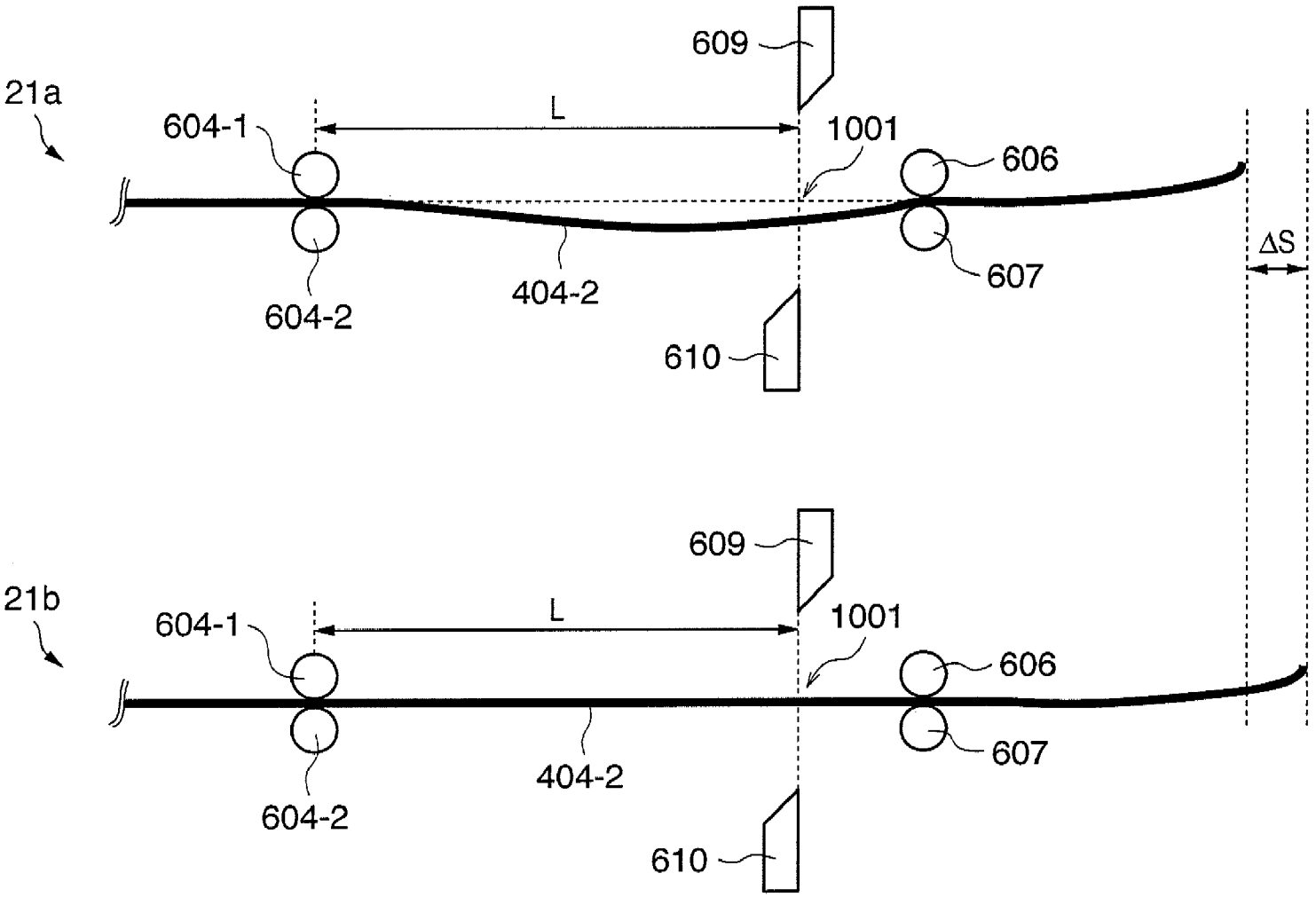
FIG. 21 is a schematic view showing the operations of the respective units of the printer 100 from completion of overcoat processing until the roll paper 404-2 is conveyed to a cutting position.

FIG. 19 is a flowchart showing the sequence of the operations of the respective units of the printer 100 after completion of the overcoat processing until the roll paper 404-2 is conveyed to the cutting position. FIGS. 20 and 21 are schematic views of the operations of the respective units.

As shown in FIG. 19, it is checked in step S1901 if the photographic printing processing on the roll paper 404-2 is complete. If it is determined that all of the Y, M, C, and overcoat processes are complete, the process advances to step S1902. In the printer 100, if it is determined that the overcoat processing is complete, the leading end of the roll paper 404-2 is located at the position of the grip roller 604-1, as shown in 20*a* in FIG. 20.

In step S1902, the roller 404-1 ad grip roller 604-1 begin to rotate to convey the roll paper 404-2 in the discharge direction. Furthermore, in step S1903 the pivot angle of the grip roller 604-1 after the beginning of rotation in step S1902 is monitored to start to measure the conveyance distance of the roll paper 404-2.

Reference numeral 20*b* in FIG. 20 shows the state of the roll paper 404-2 immediately after the roller 404-1 and grip roller 604-1 begin to rotate, and the measurement of the conveyance distance starts.

The roll paper 404-2 has a curl since it was wound around the roller 404-1. In practice, the roll paper 404-2 has a slight curl even after uncurling by uncurl roller 603-1.

It is checked in step S1904 if the leading end of the roll paper 404-2 has reached the position of the discharge roller 606. If it is determined in step S1904 that the leading end of the roll paper 404-2 has reached the position of the discharge roller 606, the process advances to step S1905 to control the discharge roller 606 to grip the roll paper 404-2 and to start rotation of the discharge roller 606.

Reference numeral 20*c* in FIG. 20 shows the state in which the leading end of the roll paper 404-2 has reached the position of the discharge roller 606 (i.e., the state before the discharge roller 606 grips the roll paper 404-2). Reference numeral 20*d* in FIG. 20 shows the state in which the discharge roller 606 grips the roll paper 404-2, and begins to rotate.

It is checked in step S1906 if the measured convey distance has reached a prescribed amount. Note that the prescribed amount is the sum of a distance (L) from the grip roller 604-1 to a cutting position 2001 and a printing size (S) to be printed by the loaded cartridge 110, that is, a predetermined length before photographic printing.

If it is determined in step S1906 that the measured conveyance distance has reached the prescribed amount, the process advances to step S1907. In step S1907, the rotations of the roller 404-1 and grip roller 604-1 are stopped. As a result, the grip roller 604-1 conveys the roll paper 404-2 by the prescribed amount in the discharge direction after beginning of rotation in step S1905.

Reference numeral 21*a* in FIG. 21 shows the state in which the rotations of the roller 404-1 and grip roller 604-1 are stopped. As shown in 21*a* in FIG. 21, the roll paper 404-2 extending between the grip roller 604-1 and discharge roller 606 bends due to the aforementioned curl.

That is, even when the grip roller 604-1 has conveyed the roll paper 404-2 by the prescribed amount (L+S), the length from the cutting position 2001 to the leading end of the roll paper 404-2 does not equal the printing size (S) due to bending of the roll paper 404-2.

For this reason, it is checked in step S1908 if a predetermined period of time has elapsed after the rotations of the roller 404-1 and grip roller 604-1 were stopped. After an elapse of the predetermined period of time, the rotation of the discharge roller 606 is stopped. That is, there will be more rotation of the discharge roller 606 than rotation of the grip roller 604-1 or rotation of the roller 404-1. Changing the amount of rotations of the discharge roller 606 and the grip roller 604-1, or changing the conveyance distance to be conveyed by the discharge roller 606 and the conveyance distance to be conveyed by the grip roller 604-1 also can perform that.

Reference numeral 21*b* in FIG. 21 shows the state in which the rotation of the discharge roller 606 is stopped after an elapse of the predetermined period of time. As shown in 21*b* in FIG. 21, since the discharge roller 606 is stopped the predetermined period of time after the grip roller 604-1 was stopped, the roll paper 404-2 between the grip roller 604-1 and discharge roller 606 is kept taut. As a result, the distance from the cutting position 2001 to the leading end of the roll paper 404-2 equals the printing size (S).

In the example of 21*a* in FIG. 21, an error ΔS is generated due to the bending between the grip roller 604-1 and discharge roller 606 (the length from the cutting position 2001 to the leading end of the roll paper 404-2 is shorter by ΔS than the printing size S). However, by executing the processes shown in FIG. 19, the error ΔS is eliminated, and the roll paper can be cut with high cutting precision.

In steps S1908 and S1909, the discharge roller is stopped after an elapse of the predetermined period of time irrespective of the size of roll paper and cutting size. However, since an error ΔS may increase as the size of roll paper and cutting size are larger, a time period from when the roller 404-1 and grip roller are stopped until the discharge roller is stopped may be varied depending on the size of roll paper and cutting size.

6.5.2 Cutting Processing

The cutting processing after the error ΔS is eliminated will be described below with reference to 20*a* to 20*d* in FIG. 20. The cutter unit integrally includes the cutter motor 221 having the gear train 608 for driving the cutter blade 609 and the cutter bed blade 610 arranged to oppose the cutter blade 609 in addition to the cutter blade 609. Note that the cutter unit is externally detachable from the printer 100.

This is to facilitate exchange of the cutter unit since the cutter blade 609 may be nicked in terms of its structure and the cutter unit may be exchanged.

Upon driving the cutter motor 221 of the cutter unit, the roll paper 404-2 is cut. As the cutting method using the cutter blade 609, this embodiment has explained the method of rubbing up the upper and lower blades like scissors to sequentially cut the roll paper 404-2 in its widthwise direction. However, the present invention is not limited to such specific method. For example, a cutting method of driving a circular rotating blade or a method of cutting the roll paper at a stroke by moving the cutter blade in a direction perpendicular to the up-and-down direction may be used.

6.5.3 Discharging

The remaining sheet of the roll paper 404-2 after its leading end portion is cut by the cutting processing is still gripped by the discharge roller 606.

From this state, the discharge roller 606 is driven to convey the sheet of the roll paper 404-2 in the discharge direction. Since the discharge kick-out roller 607 is arranged at the opposing position of the discharge roller, when the photographically printed sheet of the roll paper 404-2 is conveyed in the discharge direction, the end of the photographic printed sheet of the roll paper 404-2 engages with the gear portion of the discharge kick-out roller 607. As a result, the photographically printed sheet of the roll paper 404-2 is kicked out into a discharge box (not shown).

In this case, since a kick-out assistant lever, which is coaxially arranged with the rotation shaft of the discharge roller 606 biases the photographic printing surface of the photographically printed sheet of the roll paper 404-2 in a direction of the discharge box, the photographically printed roll paper sheet can be stored in the discharge box more reliably. Note that the discharge roller 606 is stopped after it is driven for a predetermined period of time.

6.5.4 Rewinding Roll Paper

In order to prevent the roll paper from damaging upon exchange of the cartridge, the roll paper is conveyed in the reverse direction until the leading end of the roll paper 404-2 is housed inside the cartridge, as shown in 18*e* in FIG. 18. Note that the roll paper may be rewound in the reverse convey direction upon completion of the printing operation or upon reception of a cartridge exchange instruction.

With the aforementioned operations, the printing processing (step S805) is complete.

7. Operation Upon Detection of Terminal End

The terminal end detection processing will be described in detail below. The terminal end detection processing is executed at a predetermined timing during the printing processing to confirm if the roll paper required for photographic printing remains.

7.1 Operation of Terminal End Detection Sensor

Figure 23:
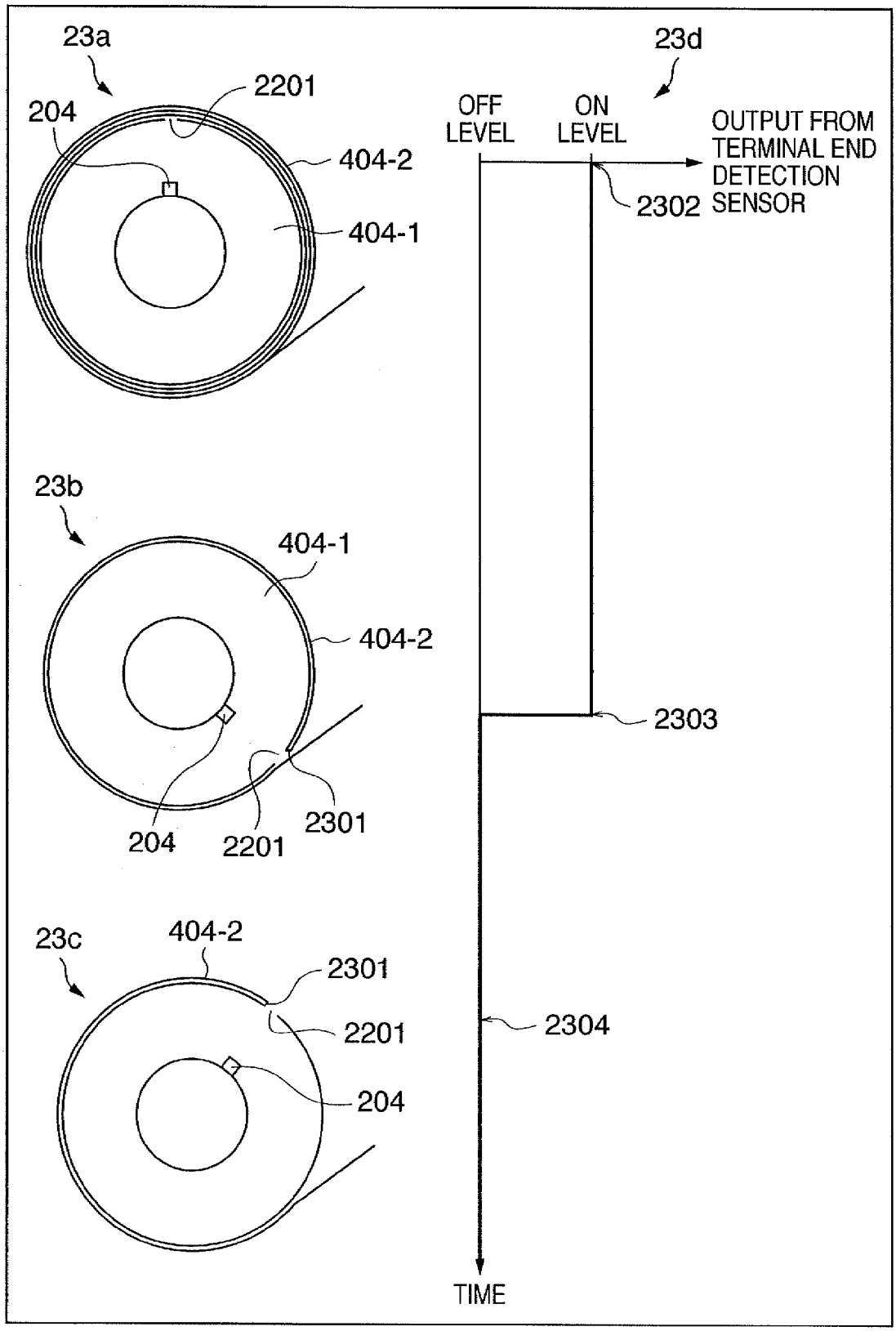
FIG. 23 is a view for explaining the operation of a terminal end detection sensor 204 during the printing processing.

The operation of the terminal end detection sensor 204 during the printing processing will be described first with reference to 23*a* to 23*d* in FIG. 23. Reference numerals 23*a* to 23*d* in FIG. 23 are views for explaining the operation of the terminal end detection sensor 204 during the printing processing. Reference numerals 23*a* to 23*c* in FIG. 23 on the left side of the plane of paper are sectional views of the roll paper unit 404. Reference numerals 23*a* to 23*c* in FIG. 23 show the consuming state of the roll paper 404-2 in turn. On the other hand, reference numeral 23*d* in FIG. 23 on the right side of the plane of paper is a graph showing a change in output from the terminal end detection sensor 204 upon consumption of the roll paper 404-2.

As described above, since the terminal end detection sensor 204 is a reflective photosensor, it receives light reflected by the terminal end detection sensor 204 in the state shown in 23*a* in FIG. 23 in which the roll paper 404-2 is wound outside the opening 2201. For this reason, the output from the terminal end detection sensor 204 is ON (level 2302).

By contrast, when the roll paper 404-2 wound outside the opening 2201 is peeled (23*b*), the terminal end detection sensor 204 can no longer receive light reflected by the roll paper 404-2, the output from the terminal end detection sensor 204 is OFF (level 2303). After that, upon supplying the roll paper 404-2 (23*c*), the output from the terminal end detection sensor 204 is kept OFF (level 2304).

As shown in 23*a* to 23*c* in FIG. 23, the opening 2201 is formed in the vicinity of a position (fixed position 2301) where the terminal end portion of the roll paper 404-2 is fixed to the surface of the roller 404-1 and behind the fixed position 2301. For this reason, when the output from the terminal end detection sensor 204 is OFF, the length of the roll paper 404-2 wound around the roller 404-1 corresponds to the circumference of the roller 404-1.

7.2 Details of Terminal End Detection Processing

Figure 24:
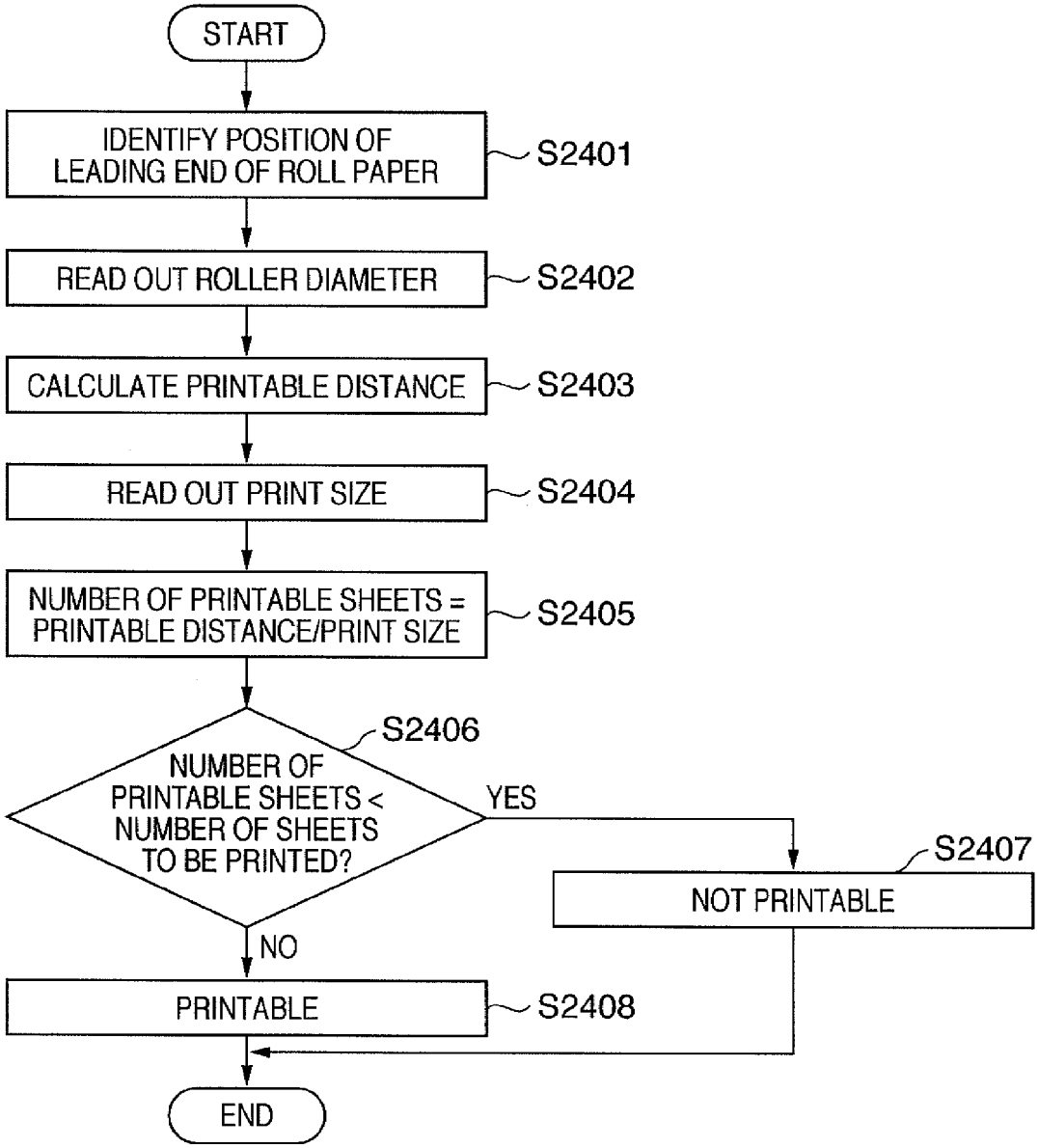
FIG. 24 is a flowchart showing the sequence of terminal end detection processing.

Details of the terminal end detection processing will be described below with reference to FIG. 24. FIG. 24 is a flowchart showing the detailed sequence of the terminal end detection processing.

In step S2401, the leading end position of the roll paper 404-2 when the terminal end detection sensor 204 is turned off is identified.

In step S2402, the circumference of the roller 404-1 is calculated based on the diameter of the roller 404-1 read out from the IC.

In step S2403, the length of the roll paper 404-2 up to the separation member 406 is calculated based on the leading end position of the roll paper 404-2 identified in step S2401. By adding the calculated length to the circumference of the roller 404-1 calculated in step S2402, the remaining amount of the roll paper 404-2 is calculated.

In case of the printer 100, a portion of the roll paper 404-2 from the separation member 406 to the photographic printing position 611 cannot be used in photographic printing (this length will be referred to as a non-photographic printable length hereinafter). Therefore, the printable length is calculated by subtracting the non-photographic printable length from the calculated remaining amount.

In step S2404, the printing size of the cartridge 110, which is read out from the IC, is read out.

In step S2405, the number of printable sheets is calculated by dividing the printable length calculated in step S2403 by the printing size read out in step S2404.

It is checked in step S2406 if the number of printable sheets calculated in step S2405 is smaller than the number of sheets to be printed. If it is determined in step S2406 that the number of printable sheets is smaller than the number of sheets to be printed, the process advances to step S2407 to recognize that the printing processing cannot be continued. On the other hand, if it is determined in step S2406 that the number of printable sheets is equal to or larger than the number of sheets to be printed, the process advances to step S2408 to recognize that the printing processing can be continued. In this manner, the printer 100 determines whether or not to continue the printing processing by checking if the number of printable sheets is equal to or larger than the number of sheets to be printed. If it is determined that the printing processing can be continued, the printing processing is executed; otherwise, the printing processing is interrupted, and the user is notified that the roll paper runs out.

As can be seen from the above description, according to this embodiment, since the terminal end detection sensor is arranged inside the roller, no opening for the sensor needs to be formed on the housing of the cartridge, thus maintaining the sealed state of the cartridge.

That is, in the printer which uses a cartridge that integrates an ink ribbon and roll paper, the remaining roll paper can be recognized while maintaining the hermetic sealed state of the cartridge.

In addition, since the terminal end detection sensor is arranged using the hollow structure of the roller, the printer can be made compacter than the case in which the terminal end detection sensor is arranged on the printer side, thus obtaining an extra effect.

Furthermore, since the distance between the terminal end detection sensor and the irradiated position of the roll paper becomes always constant irrespective of the amount of consumption of the roll paper, detection errors can be avoided, thus obtaining another extra effect.

[Second Embodiment]

The second embodiment will be described hereinafter. A cartridge of this embodiment adopts methods of pulling out and rewinding roll paper in a roll paper unit different from those in the first embodiment. Other arrangements are the same as those in the first embodiment.

More specifically, as in the first embodiment, the end portions of roll paper 404-2 can be held by notches 501 since the roll paper 404-2 is biased by flanges 404-3 in the directions of arrows 502.

On the other hand, in this embodiment, upon pulling out the roll paper 404-2 from a roll paper unit 404, the flanges 404-3 are fixed to cancel the biasing forces of the flanges 404-3. A roller 404-1 alone is rotated to pull out the roll paper 404-2 from the roll paper unit 404. When the roll paper 404-2 which has been pulled outside a cartridge 110 is rewound into the cartridge 110 upon printing, the flanges 404-3 are rotated together with the roller 404-1. In this way, the roll paper 404-2 which has already been pulled out is wound around holding units 503 again.

In this manner, there are two cases: the roller 404-1 pivots together with the flanges 404-3, and the roller 404-1 alone pivots while fixing the flanges 404-3. For this reason, the flanges 404-3 are connected to the roller 404-1 to be able to restrict the pivoting of the flanges 404-3 irrespective of the pivoting of the roller 404-1. Also, restriction members for restricting the rotation of the flanges 404-3 upon rotation of the roller 404-1 are provided to a printer 100 or a cartridge 110. With this arrangement, upon pulling out the roll paper 404-2, the flanges 404-3 can be fixed by these restriction members.

The processing upon pulling out the roll paper 404-2 will be described below with reference to 7*a* to 7*d* in FIG. 7.

Figure 7:
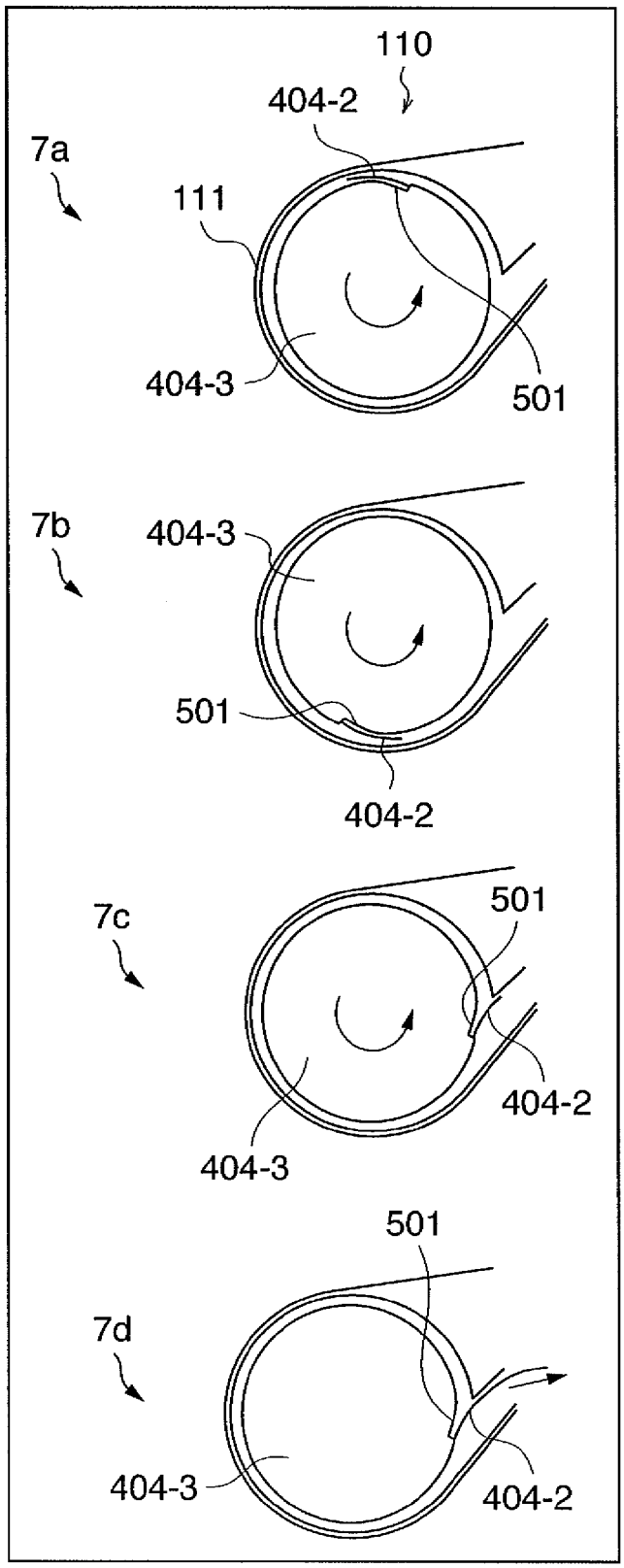
FIG. 7 is a schematic view showing the states of the roll paper unit 404 of the cartridge 110.

Reference numerals 7*a* to 7*d* in FIG. 7 are schematic views showing the states of the roll paper unit 404 immediately after the cartridge 110 is loaded into the printer 100. When the cartridge 110 is loaded into the printer 100, since the rotation shaft of the roller 404-1 is coupled to the rotation mechanism of the printer 100, the pivoting of the roller 404-1 is restricted by the printer 100.

Reference numeral 7*a* in FIG. 7 shows the state immediately after the cartridge 110 is loaded. When the cartridge 110 is loaded, and the roll paper conveyance operation starts, the roller 404-1 and flanges 404-3 are rotated by the rotation mechanism of the printer 100 (7*a*→7*b*). When the roller 404-1 and flanges 404-3 are rotated and the notches 501 reach the position shown in 7*c* in FIG. 7, the rotations of the roller 404-1 and flanges 404-3 are stopped. At this time, the end portion of the roll paper 404-2 is in contact with the separation member 406, and travels toward the cartridge exit direction to be discharged outside the cartridge 110.

Next, the flanges 404-3 are fixed, and the roller 404-1 alone is rotated. The roll paper 404-2 is rotated together with the roller 404-1, and is pulled out to the cartridge exit while being pushed out from the roll paper unit 404 (7*d* in FIG. 7).

In this manner, the roll paper is pulled out from the cartridge 110. When the turn of the roller 404-1 is stopped in the state shown in 7*d* in FIG. 7, the leading end of the roll paper 404-2 is peeled and stays in a conveyance path 601.

Figure 12:
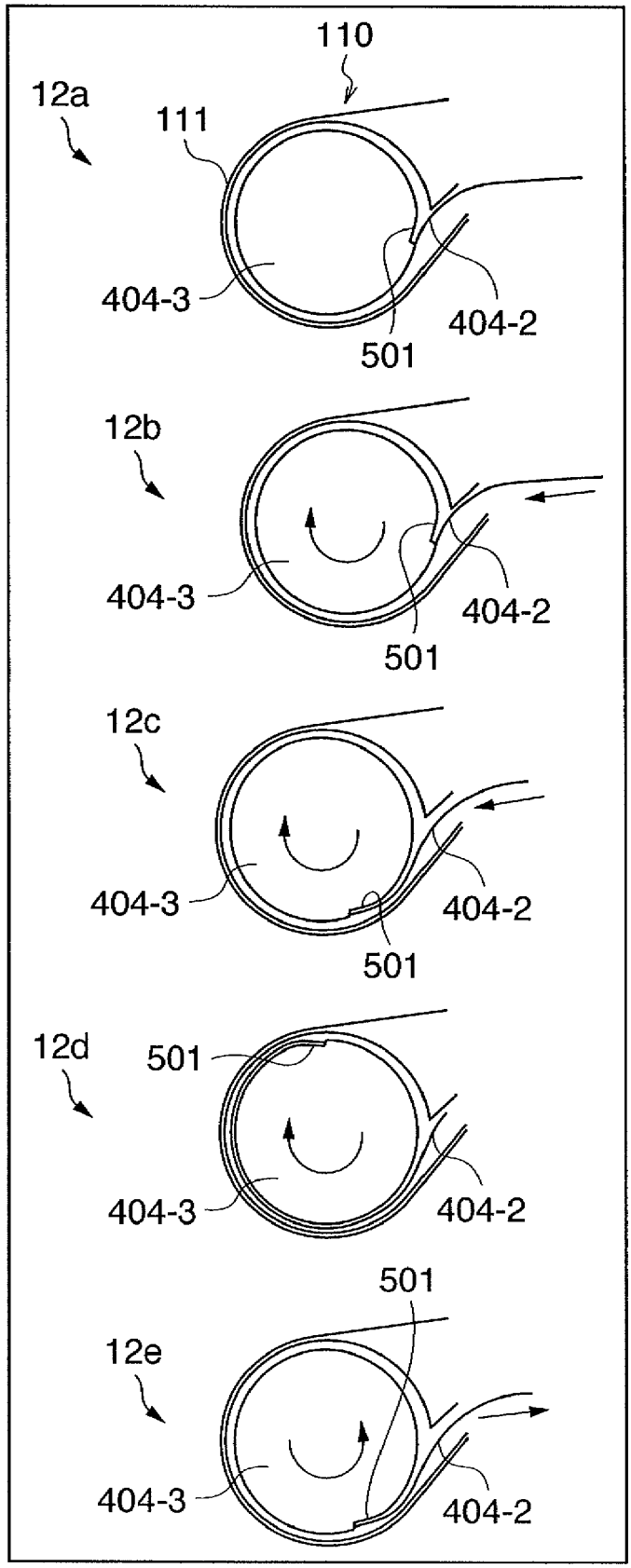
FIG. 12 is a schematic view showing the states of the roll paper unit 404 of the cartridge 110.

The processing upon rewinding the roll paper 404-2 during photographic printing will be described below with reference to 12*a* to 12*e* in FIG. 12.

When the roll paper 404-2 is pulled out from the cartridge 110 prior to photographic printing, the flanges 404-3 are fixed, and the roller 404-1 alone is rotated to pull out the roll paper 404-2 (12*a*). However, when the roll paper 404-2 is conveyed in the photographic printing direction during the photographic printing operation, and the roll paper 404-2 is housed inside the cartridge 110 again, both the roller 404-1 and flanges 403-3 are rotated (12*b*). Then, the roll paper 404-2 is wound around the holding portions 503 of the flanges 404-3 (12*c* and 12*d*). In this way, the roll paper 404-2 which has been pulled out from the cartridge 110 once is housed in the cartridge 110 while being conveyed in the photographic printing direction.

Even when the remaining amount of the roll paper 404-2 wound around the roller 404-1 changes, and the diameter of the roller 404-1 changes, the diameter of the flanges 404-3 remains the same.

For this reason, the conveyance distance of the roll paper 404-2 upon rewinding can be accurately controlled.

[Third Embodiment]

In the description of the first embodiment, upon determination of completion of the overcoat processing, the leading end of the roll paper 404-2 is located at the position of the grip roller 604-1 (20*a* in FIG. 20). However, the present invention is not limited to this, and the leading end need not be located at the position of the grip roller 604-1.

However, in this case, the conveyance distance (prescribed amount) to be conveyed by the grip roller 604-1 upon conveying to the cutting position 2001 is different.

In the first embodiment, since the leading end of the roll paper 404-2 is located at the position of the grip roller 604-1, the distance (L) is that from the grip roller 604-1 to the cutting position 2001. However, since the leading end is not located at the position of the grip roller 604-1, the prescribed amount is calculated to have L as a distance from the leading end to the cutting position 2001 in place of the distance from the grip roller 604-1 to the cutting position 2001.

[Fourth Embodiment]

Figure 25:
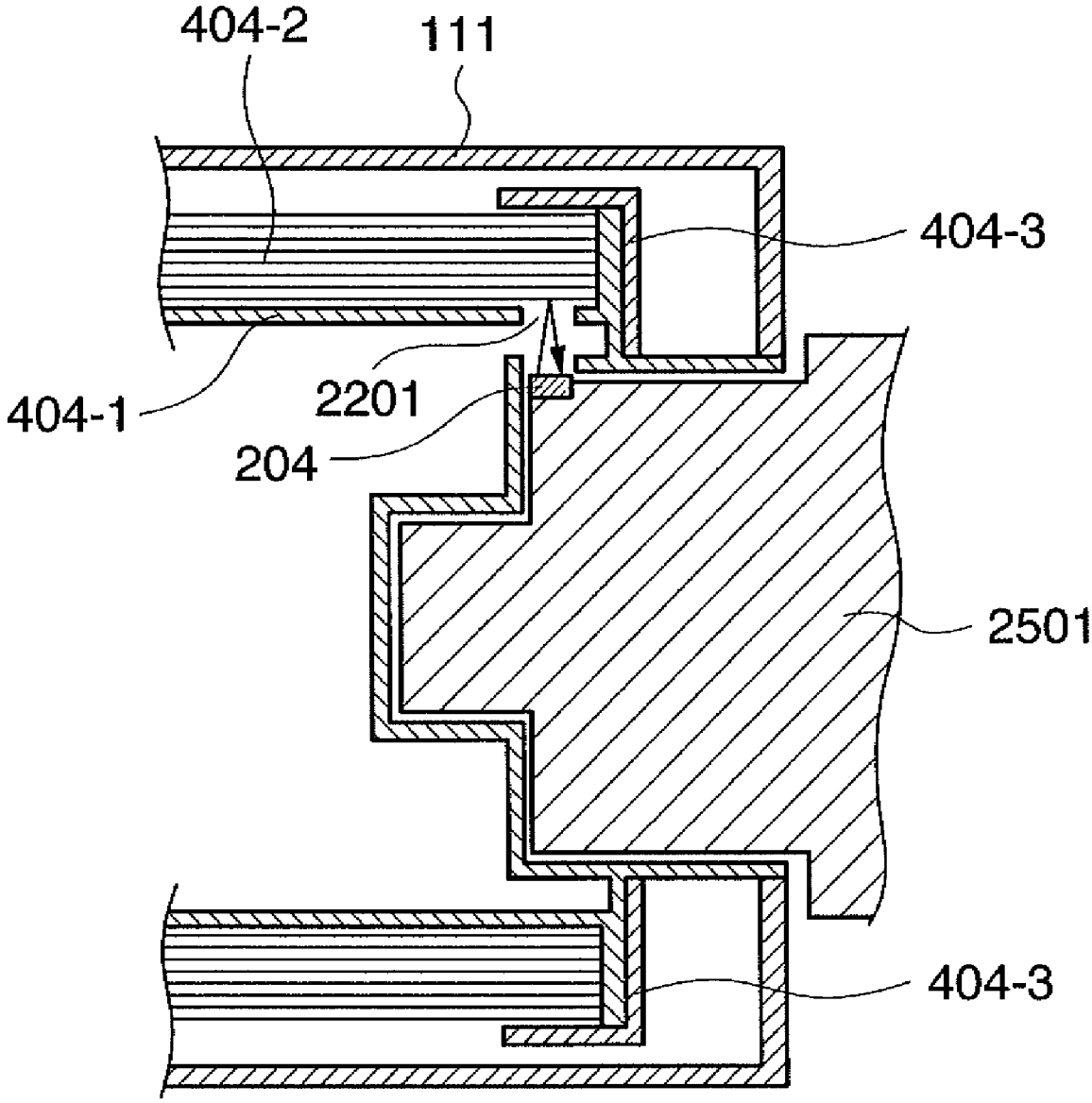
FIG. 25 is a sectional view of the roll paper unit 404.
Figure 26:
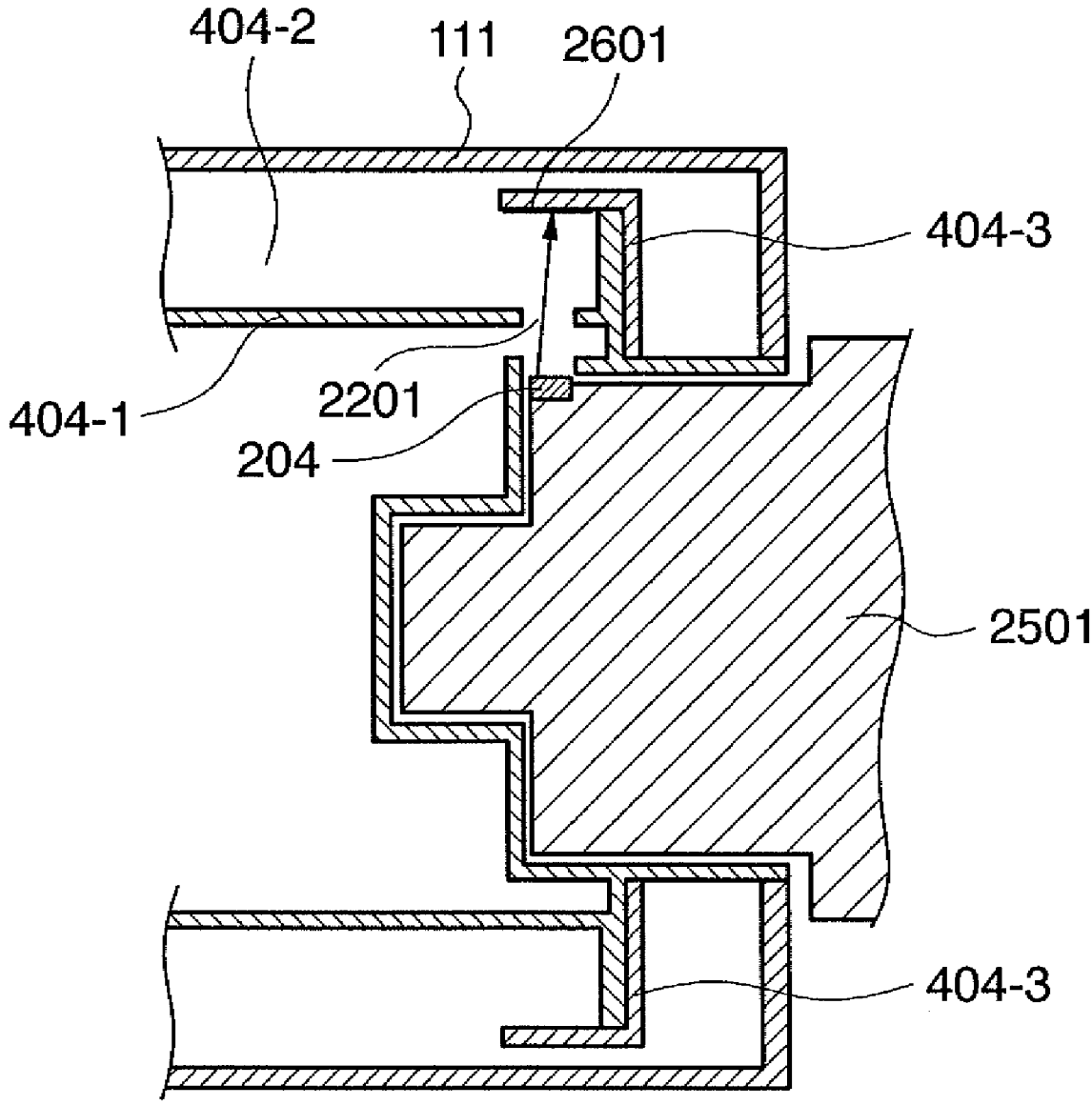
FIG. 26 is a sectional view of the roll paper unit 404.

The fourth embodiment of the present invention will be described hereinafter with reference to FIGS. 25, 26, and 27. Since the basic arrangement, the sequence of the terminal end detection processing, and the like of the fourth embodiment are the same as those of the first embodiment, a description thereof will not be repeated, and only differences from the first embodiment will be described below. Note that the same reference numerals denote the same components as in the first embodiment.

In the fourth embodiment, a terminal end detection sensor 204 is arranged not in a roll paper unit 404 but on the printer 100 side. More specifically, the terminal end detection sensor 204 is arranged on a roller driving shaft 2501 provided to a printer 100 to transmit the driving force of a feeding motor 215 to a roller 404-1 of the roll paper unit 404.

Figure 27:
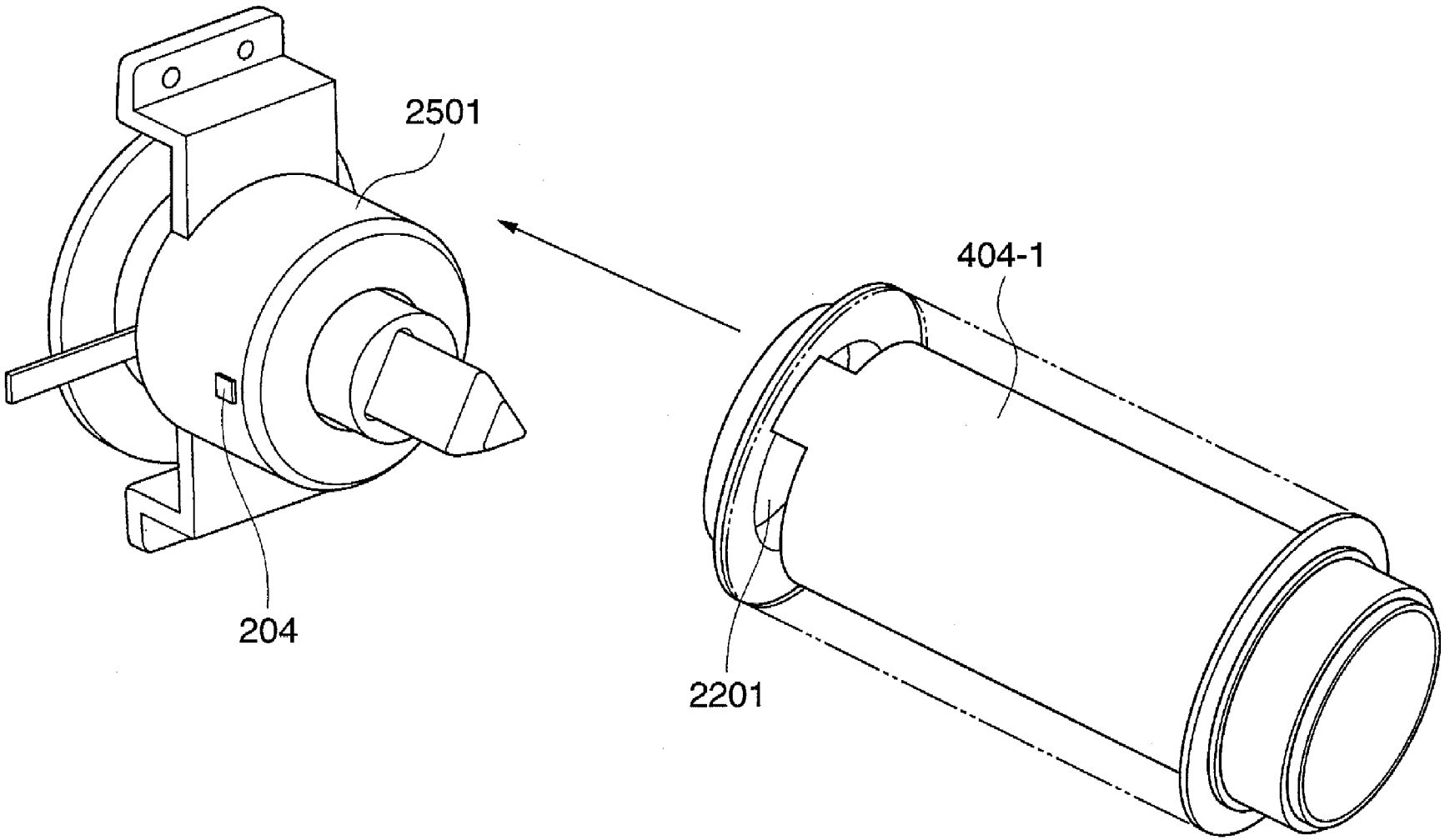
FIG. 27 is a view showing the roll paper unit 404 and a paper feed driving mechanism of the printer 100.

FIG. 27 shows the roll paper unit 404 and the feed driving mechanism of the printer 100 according to the fourth embodiment. When a cartridge 110 is loaded to the printer 100, the rotation shaft of the roller 404-1 of the roll paper unit 404 engages with a roller driving shaft 2501 of the printer 100, and the driving force of the feeding motor 215 is transmitted to the roll paper unit 404. The terminal end detection sensor 204 is provided to the roller driving shaft 2501. An opening 2201 for terminal end detection is formed in the roller 404-1 of the roll paper unit 404.

The terminal end detection processing of the fourth embodiment will be described below with reference to FIGS. 25 and 26. FIGS. 25 and 26 are sectional views of the roll paper unit 404 while the cartridge 110 is loaded into the printer 100. FIG. 25 shows the case wherein the remaining amount of a roll paper 404-2 is sufficient, and FIG. 26 shows the case in which the roll paper 404-2 is consumed and the remaining amount is small.

When the cartridge 110 is loaded, the rotation shaft of the roller 404-1 engages with the roller driving shaft 2501 of the printer 100. The terminal end detection sensor 204 is provided to the roller driving shaft 2501. This terminal end detection sensor 204 is a reflective photosensor. The sensor 204 irradiates the interior of the roll paper 404-2 with light via the opening 2201 formed on the roller 404-1, and receives light reflected by the roll paper 404-2. For this reason, the opening 2201 is formed at a position opposing the terminal end detection sensor 204 when the rotation shaft of the roller 404-1 engages with the roller driving shaft 2501 of the printer 100.

When the rotation shaft of the roller 404-1 engages with the roller driving shaft 2501 of the printer 100, if a plurality of positions of the roller 404-1 can oppose the terminal end detection sensor, a plurality of openings 2201 may be formed. For example, as shown in FIG. 27, when the engaging portion of the roller driving shaft 2501 has a triangular shape, the roll paper unit 404 can engage at three different positions. In this case, the openings are formed at three positions. That is, the openings 2201 are formed at positions and in the quantity corresponding to the shape of the engaging portion of the roller driving shaft 2501. As a result, the roll paper unit 404 can be attached so that the opening 2201 is located at the position surely opposing the terminal end detection sensor.

Also, a light absorbing member 2601 that absorbs the light from the terminal end detection sensor may be provided at the position, opposing the opening 2201, of the roll paper unit 404, so as to reliably detect the absence of the roll paper.

In this embodiment as well, since the interior of the roll paper 404-2 is irradiated with light, the distance between the terminal end detection sensor 204 and the irradiated position of the roll paper 404-2 becomes constant irrespective of the remaining amount of the roll paper 404-2 as in the first embodiment. For this reason, the terminal end can be stably and reliably detected. Unlike in the first embodiment, since the terminal end detection sensor is provided to the roller driving shaft 2501 of the printer 100, one sensor can detect the remaining amounts of a large number of cartridges 110.

Furthermore, since the opening 2201 is formed on the engaging portion with the printer 100, and the roll paper 404-2 is fixed to the roller 404-1, the roll paper 404-2 serves as a lid of the opening 2201. Hence, dust and the like can hardly enter the cartridge compared to a case in which an opening is formed on the housing 111 to externally detect the roll paper 404-2.

[Fifth Embodiment]

The fifth embodiment of the present invention will be described hereinafter with reference to FIGS. 28A to 28C. Since the basic arrangement, the sequence of the terminal end detection processing, and the like of the fifth embodiment are the same as those of the first embodiment, a description thereof will not be repeated, and only differences from the first embodiment will be described below. Note that the same reference numerals denote the same components as in the first embodiment. In the fifth embodiment, a shutter for protecting an ink ribbon is provided to a cartridge 110.

Figure 28A:
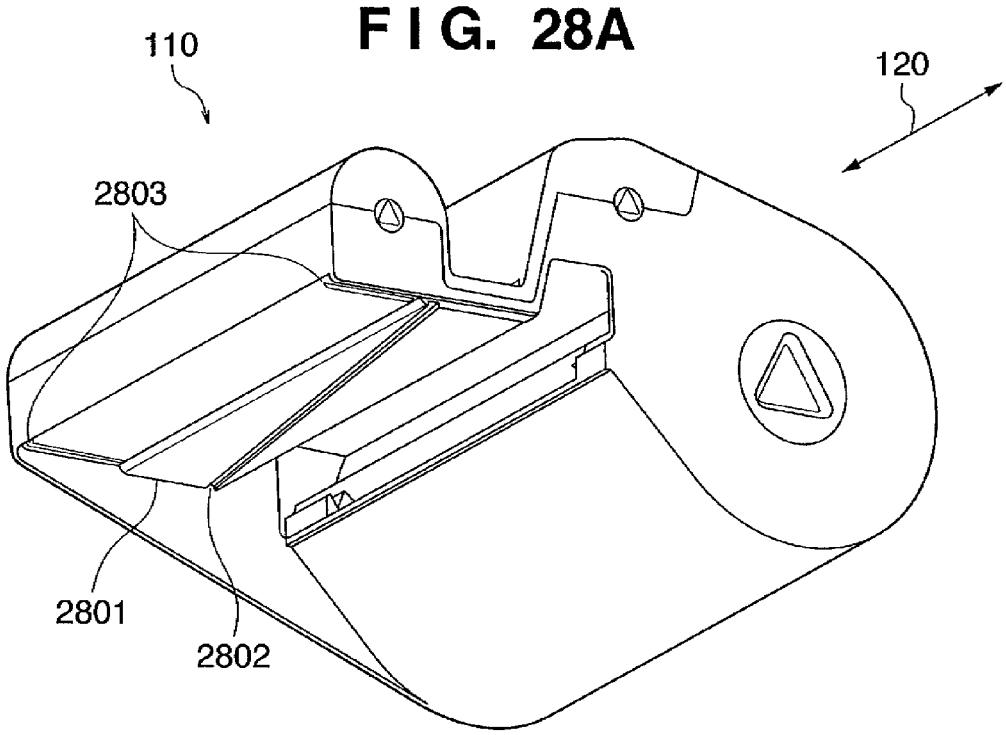
FIG. 28A is a view showing the outer appearance of the cartridge 110.

FIG. 28A shows the outer appearance of the cartridge 110 (when viewed from the bottom surface side of the cartridge 110 and from the surface to be inserted into a printer 100).

A flat surface 402-4 (not shown in FIG. 28A) is covered by a shutter 2801 (opening/closing member) (this position of the shutter 2801 will be referred to as a "closing position" hereinafter). When the cartridge 110 is loaded into the printer 100, the shutter 2801 slides along slide rails 2803, and the flat surface 402-4 is exposed from the cartridge 110 (this position of the shutter 2801 will be referred to as an "opening position" hereinafter). That is, the slide rails 2803 serve as guide paths for guiding the shutter 2801 between the closing position and the opening position. Since the slide rails 2803 are arranged, the shutter 2801 is movable between the closing position and the opening position.

A sliding groove 2802 for sliding the shutter 2801 is formed on the surface of the shutter 2801. Upon loading the cartridge 110 into the printer 100, a contact member (not shown) provided to the printer 100 slides along the sliding groove 2802, thus allowing the shutter 2801 to slide along the slide rails 2803. Note that details of the slide operation will be described later using 28*a* to 28*c* in FIG. 28C.

The shutter 2801 is biased by an elastic member in the closing direction, and the shutter 2801 slides in the opening direction against the biasing force in the closing direction.

Figure 28B:
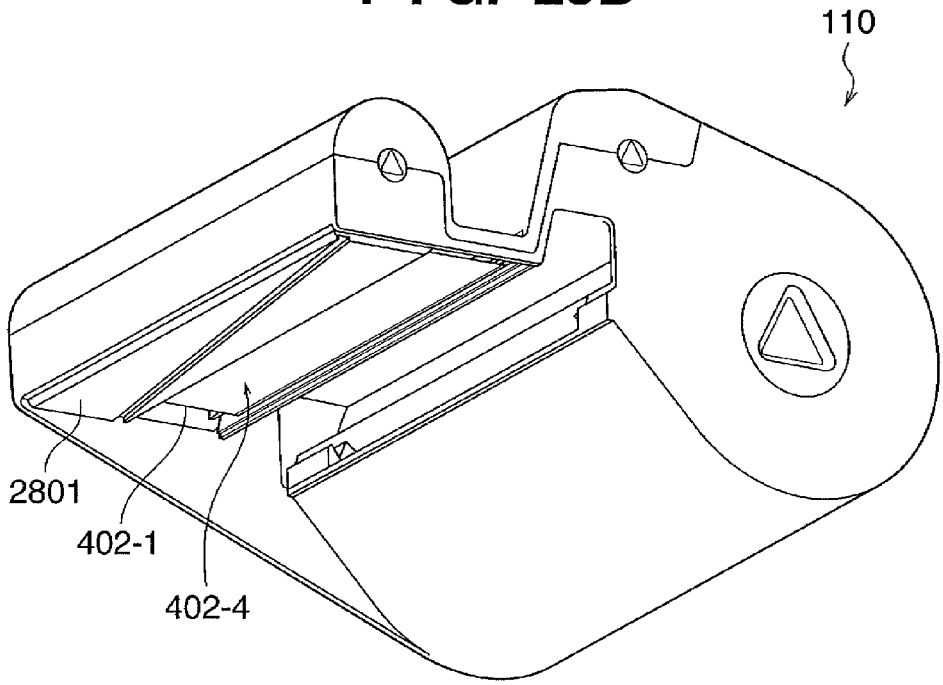
FIG. 28B is a view showing the state of the cartridge 110 after a shutter 2801 is slid.

FIG. 28B shows the state after the shutter 2801 has slid along the slide rails 2803 (to explain the position of the shutter 2801 when the cartridge 110 is loaded into the printer 100).

As shown in FIG. 28B, when the shutter 2801 slides, the flat surface 402-4 of an ink ribbon 402-1 is exposed from the cartridge 110, and is ready to be thermally transferred to roll paper 404-2 by a thermal head 227. Since the slide rails 2803 are arranged to be approximately parallel to the flat surface 402-4, the shutter 2801 slides on an identical plane.

Note that the surface of the slid shutter 2801 specifies the conveyance path of the photographic printing surface side of the roll paper 404-2 pulled out from the cartridge 110 upon photographic printing.

Figure 28C:
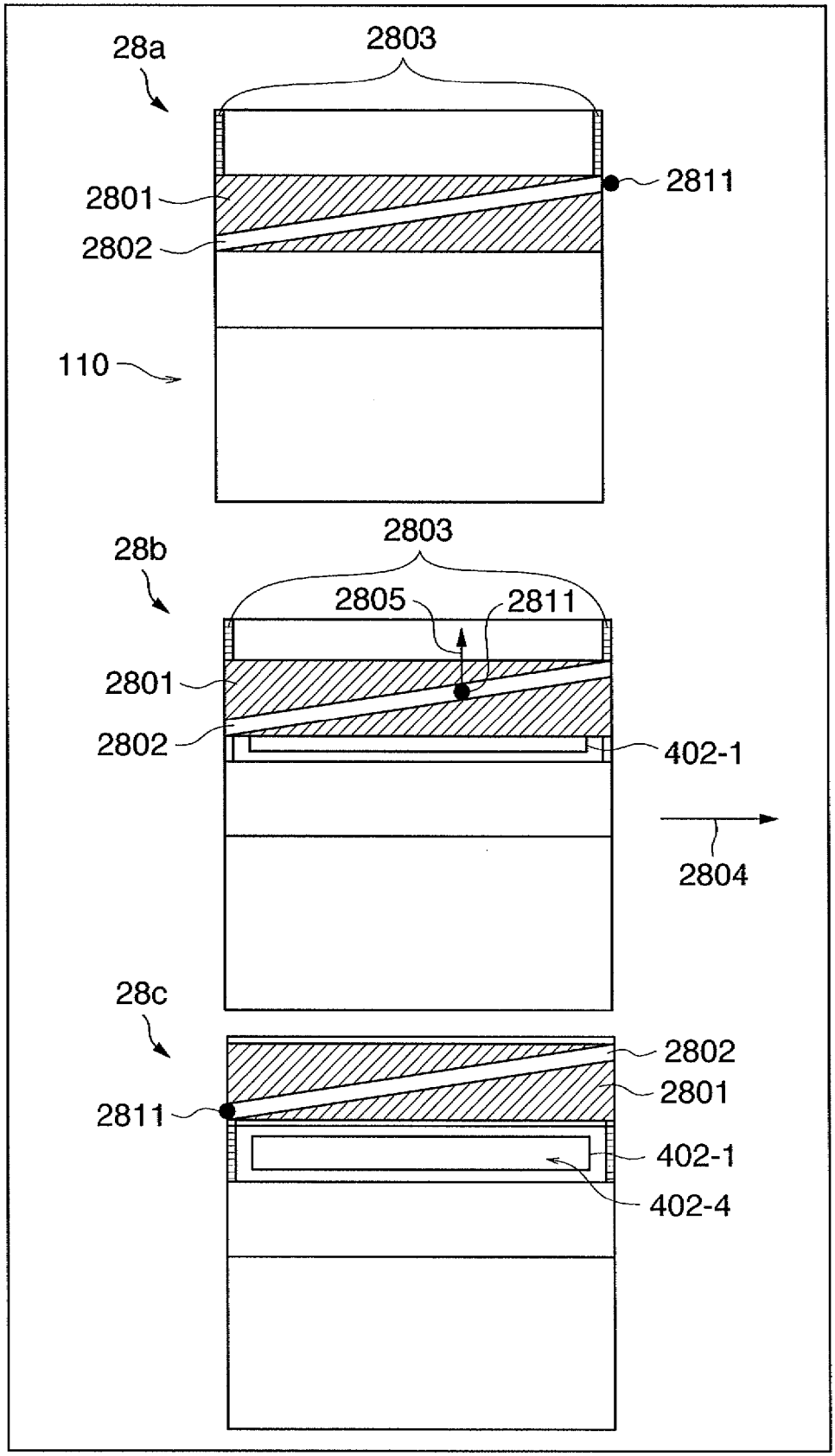
FIG. 28C is a schematic view showing the sliding states of the shutter 2801.

Reference numerals 28*a* to 28*c* in FIG. 28C are schematic views of the sliding state of the shutter 2801 upon loading the cartridge 110 into the printer 100, when viewed from the bottom surface side of the cartridge 110.

Reference numeral 28*a* in FIG. 28C shows the state immediately before the cartridge 110 is loaded into the printer 100. Reference numeral 2811 denotes a contact member which is provided to the printer 100, and is arranged to be in contact with the sliding groove 2802 formed on the surface of the shutter 2801 upon loading the cartridge 110.

Reference numeral 28*b* in FIG. 28C shows the state of the cartridge 110 during operation in the loading direction. For the sake of convenience, the contact member 2811 is moving. However, in practice, the contact member 2811 is fixed inside the printer 100, and the cartridge 110 side moves in the direction of an arrow 2804.

When the cartridge 110 moves in the direction of an arrow 2804, the shutter 2801 is biased by the contact member 2811 in the direction of an arrow 2805, and moves in the direction of the arrow 2805 along the slide rails 2803.

Reference numeral 28*c* in FIG. 28C shows the state after completion of loading of the cartridge 110 into the printer 100. Upon completion of loading of the cartridge 110, the flat surface 402-4 of the ink ribbon 402-1 is exposed outside the cartridge 110.

At this time, the contact member 2811 is located at the end of the sliding groove 2802. As described above, the shutter 2801 is biased by the elastic member in the closing direction. Upon completion of loading of the cartridge 110, since the contact member 2811 is located at the end of the sliding groove 2802, the closing position of the shutter 2801 is maintained.

As can be apparent from the above description, in this embodiment, since the ink ribbon is covered by the shutter which is free to open and close on the bottom surface side of the cartridge, the degree of hermetic seal of the cartridge can be improved.

In this embodiment, the sliding groove is formed on the shutter, and the contact member arranged on the printer side biases the shutter in the opening direction along the sliding grove upon loading the cartridge into the printer. In this way, the arrangement in which the ink ribbon is exposed from the cartridge upon completion of loading can be realized at low cost. After completion of loading of the cartridge, the photographic printing operation can be smoothly made.

In this embodiment, upon loading the cartridge, the shutter slides parallelly, and specifies the conveyance path of the roll paper when it is opened. In this manner, the roll paper can be smoothly conveyed upon photographic printing.

[Sixth Embodiment]

In the fifth embodiment, the shutter slides parallelly, and specifies the conveyance path of the roll paper when it is opened. However, the present invention is not limited to this, but the shutter may specify the conveyance path of the surface opposite to the photographic printing surface of the roll paper.

The arrangement of the shutter of the cartridge according to this embodiment will be described below with reference to FIGS. 29A to 29C.

Figure 29A:
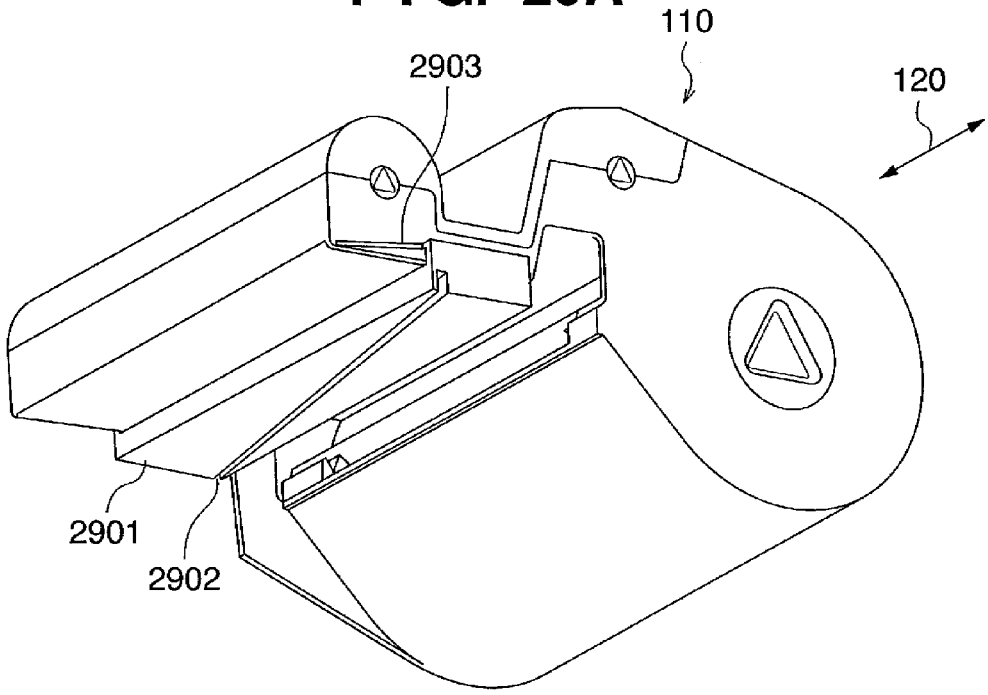
FIG. 29A is a view showing the outer appearance of the cartridge 110.

FIG. 29A shows the outer appearance of a cartridge 110 according to this embodiment (when viewed from the bottom surface side of the cartridge 110 and from the surface side to be loaded into a printer 100).

A flat surface 402-4 (not shown in FIG. 29A) is covered by a shutter 2901 (opening/closing member). This position of the shutter 2901 will be referred to as an "opening position" hereinafter. When the cartridge 110 is loaded into the printer 100, the shutter 2901 slides along slide rails 2903, which are obliquely formed with respect to the flat surface 402-4, and the flat surface 402-4 is exposed from the cartridge 110 (FIG. 29B). This position of the shutter 2901 will be referred to as a "closing position"hereinafter. That is, the slide rails 2903 serve as guide paths for guiding the shutter 2901 between the opening position and the closing position.

A sliding groove 2902 for sliding the shutter 2901 is formed on the surface of the shutter 2901. Upon loading the cartridge 110 into the printer 100, a contact member (not shown) provided to the printer 100 slides along the sliding groove 2902, thus allowing the shutter 2901 to slide obliquely downward (in FIG. 29A) along the slide rails 2903. Note that details of the slide operation will be described later using 29*a* to 29*c* in FIG. 29C.

The shutter 2901 is biased by an elastic member in the closing direction, and the shutter 2901 slides in the opening direction against the biasing force in the closing direction.

Figure 29B:
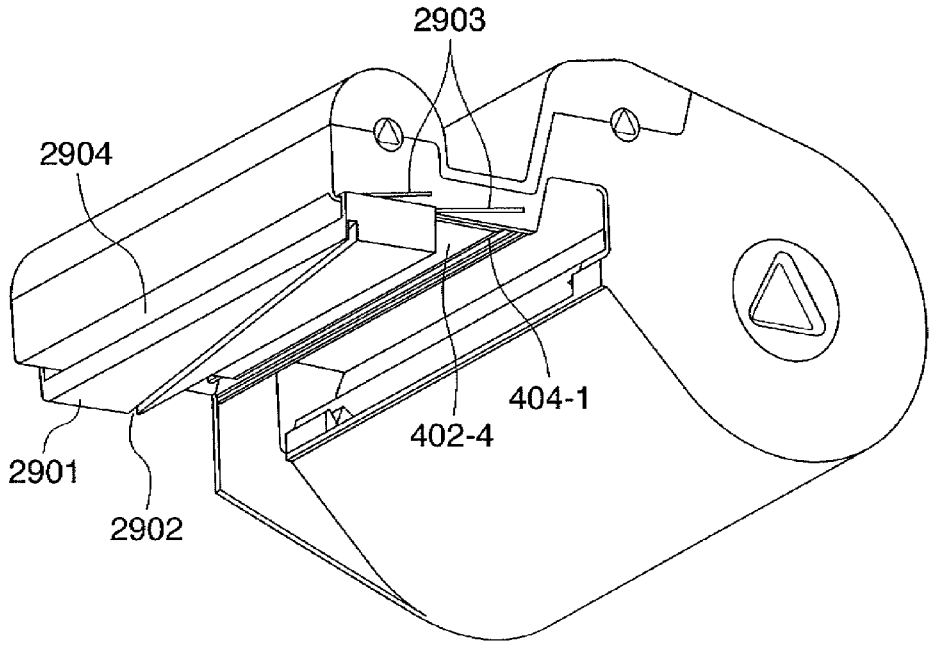
FIG. 29B is a view showing the state of the cartridge 110 after a shutter 2901 is slid.

FIG. 29B shows the state after the shutter 2901 has slid along the slide rails 2903. FIG. 29B shows the position (closing position) of the shutter 2901 when the cartridge 110 is loaded into the printer 100.

As shown in FIG. 29B, when the shutter 2901 slides, the flat surface 402-4 of an ink ribbon 402-1 is exposed from the cartridge 110, and is ready to be thermally transferred to roll paper 404-2 by a thermal head 227.

Note that the reverse surface of the slide shutter 2901 specifies the conveyance path of the roll paper 404-2 pulled out from the cartridge 110 upon photographic printing. That is, an opening 2904 which is formed between the shutter 2901 and the housing 111 serves as the conveyance path of the roll paper 404-2.

Figure 29C:
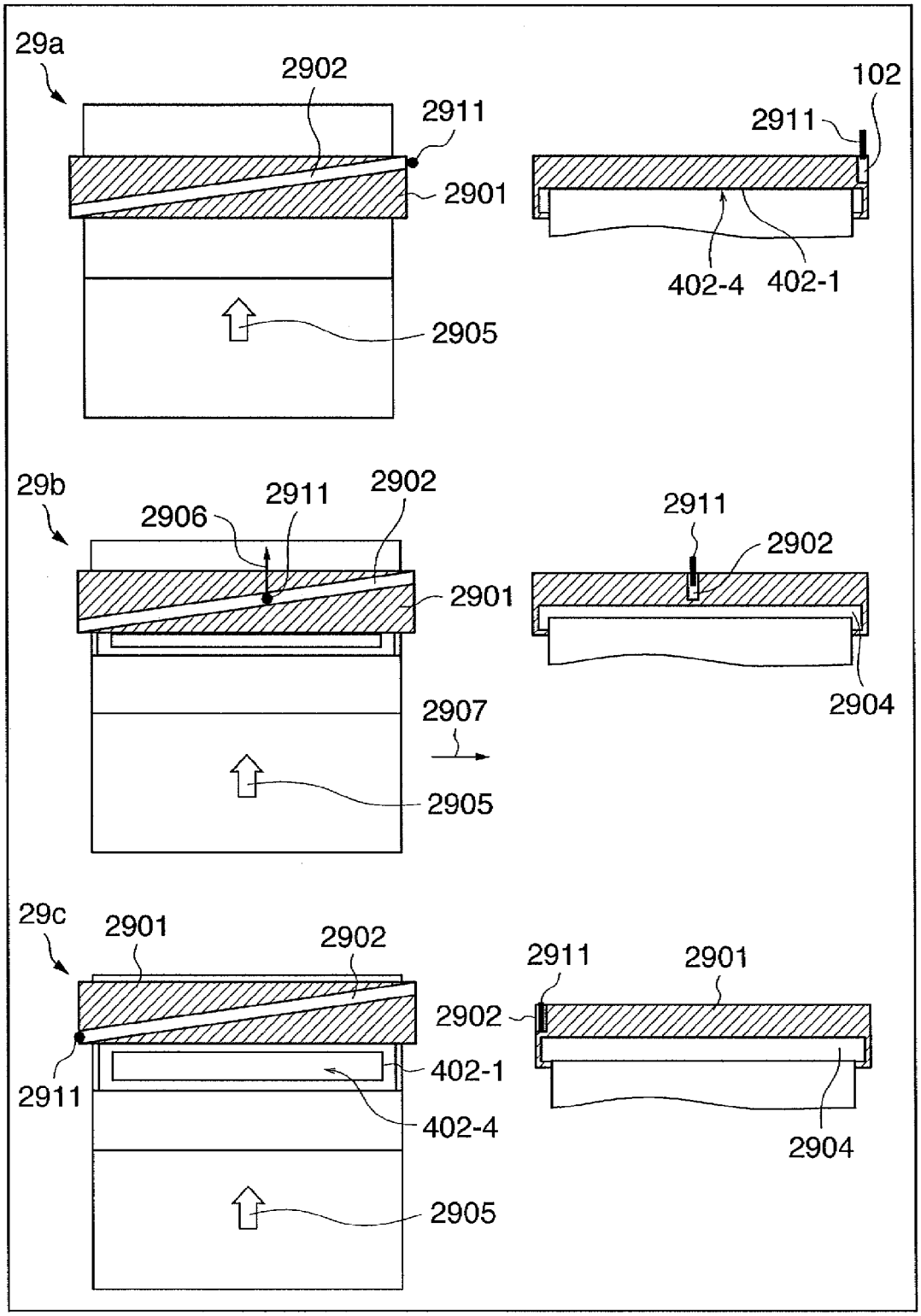
FIG. 29C is a schematic view showing the sliding states of the shutter 2901.

Reference numerals 29*a* to 29*c* in FIG. 29C are schematic views showing details of the sliding operation of the shutter 2901.

Each drawing on the left side of the plane of paper is a schematic view showing the state of the shutter 2901 when viewed from the bottom surface of the cartridge 110. Each drawing on the right side of the plane of paper is a sectional view of the state of the shutter 2901 when viewed from the direction of an arrow 2905, that is, a sectional view at each position of a contact member 2911 (to be described later).

Reference numeral 29*a* in FIG. 29C shows the state immediately before the cartridge 110 is loaded into the printer 100. Reference numeral 2911 denotes a contact member which is provided to the printer 100, and is arranged to be in contact with the sliding groove 2902 formed on the surface of the shutter 2901 upon loading the cartridge 110. At this time, the flat surface 402-4 of the ink ribbon 402-1 is covered by the shutter 2901.

Reference numeral 29*b* in FIG. 29C shows the state of the cartridge 110 during operation in the loading direction. For the sake of convenience, the contact member 2911 is moving. However, in practice, the contact member 2911 is fixed inside the printer 100, and the cartridge 110 side moves in the direction of an arrow 2907.

Upon movement of the cartridge 110 in the direction of the arrow 2907, the shutter 2901 is biased by the contact member 2911 in the direction of an arrow 2906, and moves in the direction of the arrow 2906 along the slide rails 2903. As described above, since the slide rails 2903 are formed obliquely with respect to the flat surface 402-4, the shutter 2901 translates in a direction to be separated away from the housing 111 of the cartridge 110, thus forming the opening 2904.

Reference numeral 29*c* in FIG. 29C shows the state after completion of loading of the cartridge 110 into the printer 100. Upon completion of loading of the cartridge 110, the flat surface 402-4 of the ink ribbon 402-1 is exposed outside the cartridge 110.

At this time, the contact member 2911 is located at the end of the sliding groove 2902. As described above, the shutter 2901 is biased by the elastic member in the closing direction. Upon completion of loading of the cartridge 110, since the contact member 2911 is located at the end of the sliding groove 2902, the opening position of the shutter 2901 is maintained. Note that the maximum opening 2904 is formed at the opening position of the shutter 2901.

As is apparent from the above description, in this embodiment, since the ink ribbon is covered by the shutter which is free to open and close on the bottom surface side of the cartridge, the degree of hermetic seal of the cartridge can be improved.

In this embodiment, the sliding groove is formed on the shutter, and the contact member arranged on the printer side biases the shutter in the opening direction along the sliding grove upon loading the cartridge into the printer. In this way, the arrangement in which the ink ribbon is exposed from the cartridge upon completion of loading can be realized at low cost. After completion of loading of the cartridge, the photographic printing operation can be smoothly made.

In this embodiment, the slide rails are obliquely formed so that the shutter is in tight contact with the cartridge when it is located at the closing position, and the shutter is separated from the cartridge by a predetermined distance to form the opening when the shutter is located at the opening position. With this arrangement, when the shutter is located at the opening position, the roll paper passes through the opening, and the reverse surface of the shutter can serve as the conveyance path that specifies the surface opposite to the photographic printing surface of the roll paper. As a result, the roll paper can be stably and smoothly conveyed upon photographic printing.

[Seventh Embodiment]

In the fifth and sixth embodiments, the shutter operates upon loading of the cartridge. However, the present invention is not limited to such specific embodiments, and other members may operate in cooperation with the shutter. For example, a stopper (rock member) for restricting the rotation of the ink ribbon take-up roller or supply roller (holding member for holding the ink ribbon) may be locked/unlocked in cooperation with the shutter.

With this arrangement, when the cartridge is detached, the rotation of the ink ribbon is restricted; when the cartridge is attached, the rotation of the ink ribbon is allowed using the ink ribbon take-up motor.

[Other Embodiments]

Note that the present invention may be applied to either a system constituted by a plurality of devices (e.g., a host computer, interface device, reader, printer, and the like), or an apparatus consisting of a single device (e.g., a copying machine, facsimile apparatus, or the like).

The above embodiments can be selectively combined.

The objects of the present invention are also achieved by supplying a storage medium, which records a program code of software that implements the functions of the aforementioned embodiments to the system or apparatus. In this case, the functions are implemented when a computer (or a CPU or MPU) of the system or apparatus reads out and executes the program code stored in the storage medium. Note that the storage medium that stores the program code constitutes the present invention in such case.

As the storage medium for supplying the program code, for example, a Floppy® disk, hard disk, optical disk, magneto-optical disk, CD-ROM, CD-R, magnetic tape, nonvolatile memory card, ROM, and the like may be used.

The present invention is not limited to the case in which the functions of the aforementioned embodiments are implemented when the computer executes the readout program code. For example, the present invention also includes a case wherein an OS (operating system) running on a computer may execute some or all of actual processes based on an instruction of the program code to implement the functions of the aforementioned embodiments.

Furthermore, the present invention also includes a case wherein the functions of the aforementioned embodiments are implemented after the program code read out from the storage medium is written in a function expansion board or unit, which is inserted into or connected to the computer. That is, the present invention includes a case wherein after the program code is written in a memory, a CPU or the like equipped on the function expansion board or unit executes some or all of actual processes to implement the functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-069061 filed Mar. 16, 2007, No. 2007-069062 filed Mar. 16, 2007, No. 2007-069063 filed Mar. 16, 2007, No. 2007-069064 filed Mar. 16, 2007, No. 2007-075401 filed Mar. 22, 2007 and No. 2008-016843 filed Jan. 28, 2008, which are hereby incorporated by reference herein in their entirety.

The invention claimed is:

1. A cartridge detachable from a printer for printing an image on roll paper, said cartridge comprising:

roll paper wound around a roller;

flanges that (i) are provided to end portions of the roller, (ii) are used to hold said roll paper wound around the roller, and (iii) are made up of elastic members; and a separation member that is used to feed out said roll paper to outside of said cartridge, wherein said roll paper is brought into contact with said separation member and is fed outside of said cartridge when the roller is rotated in a direction to feed out said roll paper, wherein said roll paper that has been fed outside of said cartridge is taken up on outer circumferential portions of said flanges, and is rewound into said cartridge when the roller is rotated in a direction to rewind said roll paper, wherein the outer circumferential potions of said flanges comprise cylindrical holding portions that are used to take up said roll paper, and when the roller is rotated in the direction to feed out said roll paper the holding portions are deformed such that said roll paper is pulled from an inner side to an outer side of the holding portions, and wherein the holding potions are formed with notches, and the notches prevent said roll paper from being pulled inside the holding portions when the roller is rotated in the direction to rewind said roll paper.

2. The cartridge according to claim 1, wherein, when the roller is rotated in the direction to rewind said roll paper, said roll paper is taken up on an outer side of the holding portions to have the notches of the holding portion as an origin.

3. A cartridge detachable from a printer for printing an image on roll paper, said cartridge comprising:

roll paper wound around a roller;

flanges that (i) are provided to end portions of the roller, (ii) are used to hold said roll paper wound around the roller, and (iii) are made up of elastic members; and a separation member that is used to feed out said roll paper to outside of said cartridge, wherein said roll paper is brought into contact with said separation member and is fed outside of said cartridge when the roller is rotated in a direction to feed out said roll paper, wherein said roll paper that has been fed outside of said cartridge is taken up on outer circumferential portions of said flanges, and is rewound into said cartridge when the roller is rotated in a direction to rewind said roll paper, and wherein said separation member has a slope for supporting, at end portions of said roll paper in a widthwise direction, said roll paper that is in contact with said separation member.

4. A printer for printing an image on roll paper, said printer comprising:

a loading portion in which a cartridge is loaded, the cartridge including (a) roll paper wound around a roller, (b) flanges that (i) are provided to end portions of the roller, (ii) are used to hold the roll paper wound around the roller, and (iii) are made up of elastic members, and (c) a separation member that is used to feed out the roll paper to outside of the cartridge; and a rotation driving portion for driving rotation of the roller of the cartridge loaded into said loading portion, wherein the roll paper is brought into contact with the separation member and is fed outside the cartridge when the roller is rotated in a direction to feed out the roll paper, wherein the roll paper that has been fed outside of the cartridge is taken up on outer circumferential portions of the flanges, and is rewound into the cartridge when the roller is rotated in a direction to rewind the roll paper, wherein the outer circumferential potions of the flanges comprise cylindrical holding portions that are used to take up the roll paper, and when the roller is rotated in the direction to feed out the roll paper the holding portions are deformed such that the roll paper is pulled from an inner side to an outer side of the holding portions, and wherein the holding potions are formed with notches, and the notches prevent the roll paper from being pulled inside the holding portions when the roller is rotated in the direction to rewind the roll paper.

5. A printer for printing an image on roll paper, said printer comprising:

a loading portion in which a cartridge is loaded, the cartridge including (a) roll paper wound around a roller, (b) flanges that (i) are provided to end portions of the roller, (ii) are used to hold the roll paper wound around the roller, and (iii) are made up of elastic members, and (c) a separation member that is used to feed out the roll paper to outside of the cartridge; and a rotation driving portion for driving rotation of the roller of the cartridge loaded into said loading portion, wherein the roll paper is brought into contact with the separation member and is fed outside the cartridge when the roller is rotated in a direction to feed out the roll paper, wherein the roll paper that has been fed outside of the cartridge is taken up on outer circumferential portions of the flanges, and is rewound into the cartridge when the roller is rotated in a direction to rewind the roll paper, and wherein the separation member has a slope for supporting, at end portions of the roll paper in a widthwise direction, the roll paper that is in contact with the separation member.

* * * * *